US011589670B2

(12) United States Patent
VanTongeren

(10) Patent No.: US 11,589,670 B2
(45) Date of Patent: Feb. 28, 2023

(54) EDGE CLEANING BRUSHES FOR FLOOR CLEANER

(71) Applicant: BISSELL Inc., Grand Rapids, MI (US)

(72) Inventor: Todd R. VanTongeren, Ada, MI (US)

(73) Assignee: BISSELL Inc., Grand Rapids, MI (US)

( * ) Notice: Subject to any disclaimer, the term of this patent is extended or adjusted under 35 U.S.C. 154(b) by 320 days.

(21) Appl. No.: 17/007,450

(22) Filed: Aug. 31, 2020

(65) Prior Publication Data

US 2021/0068524 A1 Mar. 11, 2021

Related U.S. Application Data

(60) Provisional application No. 62/896,751, filed on Sep. 6, 2019.

(51) Int. Cl.

| | |
|---|---|
| ***A46B 7/08*** | (2006.01) |
| ***A46B 9/02*** | (2006.01) |
| ***A46B 13/00*** | (2006.01) |
| ***A47L 7/02*** | (2006.01) |
| ***A47L 9/00*** | (2006.01) |
| ***A47L 9/04*** | (2006.01) |

(52) U.S. Cl.

CPC ..... *A46B 7/08* (2013.01); *A46B 9/028* (2013.01); *A46B 13/008* (2013.01); *A47L 7/02* (2013.01); *A47L 9/009* (2013.01); *A47L 9/0472* (2013.01); *A47L 2201/04* (2013.01)

(58) Field of Classification Search

CPC ..... A46B 7/08; A46B 9/028; A46B 13/008; A47L 7/02; A47L 9/009; A47L 9/0472; A47L 2201/04

See application file for complete search history.

(56) References Cited

U.S. PATENT DOCUMENTS

| | | | | |
|---|---|---|---|---|
| 9,314,141 | B2 * | 4/2016 | Lee | A47L 11/24 |
| 9,901,234 | B1 * | 2/2018 | Ebrahimi Afrouzi | A47L 9/2831 |
| 10,045,675 | B2 | 8/2018 | Haegermarck | |
| 2005/0166356 | A1 | 8/2005 | Uehigashi | |
| 2006/0236491 | A1 | 11/2006 | Baek | |
| 2014/0130294 | A1 * | 5/2014 | Li | A47L 9/0488 15/372 |
| 2016/0157692 | A1 * | 6/2016 | Maoro | A46B 13/008 15/207.2 |
| 2016/0331200 | A1 | 11/2016 | Yang et al. | |

(Continued)

FOREIGN PATENT DOCUMENTS

| | | | | |
|---|---|---|---|---|
| DE | 102015101587 | B3 * | 7/2015 | A47L 11/4038 |
| DE | 102015114265 | A1 * | 3/2017 | A47L 11/24 |

(Continued)

OTHER PUBLICATIONS

JP-2005006857-A—English Machine Translation (Year: 2005).*
Bissell EV675 Robotic Vacuum User Guide 2503 Series, 2018.

*Primary Examiner* — Marc Carlson
(74) *Attorney, Agent, or Firm* — Warner Norcross + Judd LLP

(57) ABSTRACT

A floor cleaner can include a housing adapted for movement over a surface to be cleaned and at least one edge cleaning brush provided on the housing. The edge cleaning brush includes multiple cleaning implements which rotate at different velocities. A gear system, such as a planetary gear system, can drive one cleaning implement at a lower speed than another cleaning implement.

19 Claims, 15 Drawing Sheets

(56) References Cited

U.S. PATENT DOCUMENTS

| | | | | |
|---|---|---|---|---|
| 2018/0317724 | A1* | 11/2018 | Cheung | A47L 9/1409 |
| 2018/0325252 | A1* | 11/2018 | Hopke | A46B 13/008 |
| 2021/0022574 | A1* | 1/2021 | Harting | A47L 9/0411 |

FOREIGN PATENT DOCUMENTS

| | | | | | |
|---|---|---|---|---|---|
| DE | 102017103775 | A1 | * | 8/2018 | |
| DE | 102017103775 | A1 | | 8/2018 | |
| EP | 2449937 | A2 | | 5/2012 | |
| EP | 3031352 | A1 | | 6/2016 | |
| EP | 3082541 | | | 10/2016 | |
| EP | 3229983 | | | 2/2019 | |
| EP | 3023045 | | | 3/2019 | |
| JP | 2005006857 | A | * | 1/2005 | |
| JP | 2005006857 | A | | 1/2005 | |
| JP | 2019037768 | A | * | 3/2019 | A46B 13/001 |
| KR | 20150134797 | A | * | 12/2015 | |
| WO | 2018208655 | | | 11/2018 | |
| WO | 2020006182 | | | 1/2020 | |

* cited by examiner

EDGE CLEANING BRUSHES FOR FLOOR CLEANER

CROSS-REFERENCE TO RELATED APPLICATION(S)

This application claims the benefit of U.S. Provisional Application No. 62/896,751, filed Sep. 6, 2019, which is incorporated herein by reference in its entirety.

BACKGROUND

Autonomous or robotic floor cleaners can move without the assistance of a user or operator to clean a floor surface. For example, the floor cleaner can be configured to vacuum or sweep dirt (including dust, hair, and other debris) into a collection bin carried on the floor cleaner. The floor cleaner can move randomly about a surface while cleaning the floor surface or use a mapping/navigation system for guided navigation about the surface. Some floor cleaners are further configured to apply and extract liquid for wet cleaning of bare floors, carpets, rugs, and other floor surfaces.

Floor cleaners include one or more cleaning implements for removing debris from the floor surface. For example, robot and other types of floor cleaners use brushes to propel debris toward a suction nozzle or debris inlet. A side or edge cleaning brush may rotate about a substantially vertical axis and sweep debris under the robot for collection, and clean hard-to reach spaces such as along edges and in corners of a room, including edges or corners created by walls, baseboards, cabinetry, furniture, etc. Such edge cleaning brushes often have bristles that can fling debris outside the cleaning path of the robot 10, rather than collecting debris.

BRIEF SUMMARY

In one aspect, the disclosure relates to an edge cleaning brush for a floor cleaner. The edge cleaning brush can include multiple cleaning implements and a system for driving one cleaning implement at a lower speed than another cleaning implement.

In one embodiment, a floor cleaner for cleaning a floor surface includes a housing adapted for movement over a surface to be cleaned, and an edge cleaning brush mounted on the housing. The edge cleaning brush includes a first cleaning implement configured to rotate at a first velocity, and a second cleaning implement configured to rotate at a second velocity that is greater than the first velocity.

In another embodiment, an autonomous floor cleaner includes an autonomously moveable housing, a drive system for autonomously moving the housing over the surface to be cleaned, and a controller for controlling the operation of the autonomous floor cleaner. At least one edge cleaning brush is mounted on the housing and includes multiple cleaning implements and a gear system for driving one cleaning implement at a lower speed than another cleaning implement. In certain embodiments, the gear system is a planetary gear system.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to brushes for surface cleaning apparatus that clean floor surfaces, including bare floors such as hardwood, tile, and stone, and soft surfaces such as carpets and rugs. More specifically, the disclosure relates to edge cleaning brushes for autonomous floor cleaners and other surface cleaning apparatus.

Figure 1:
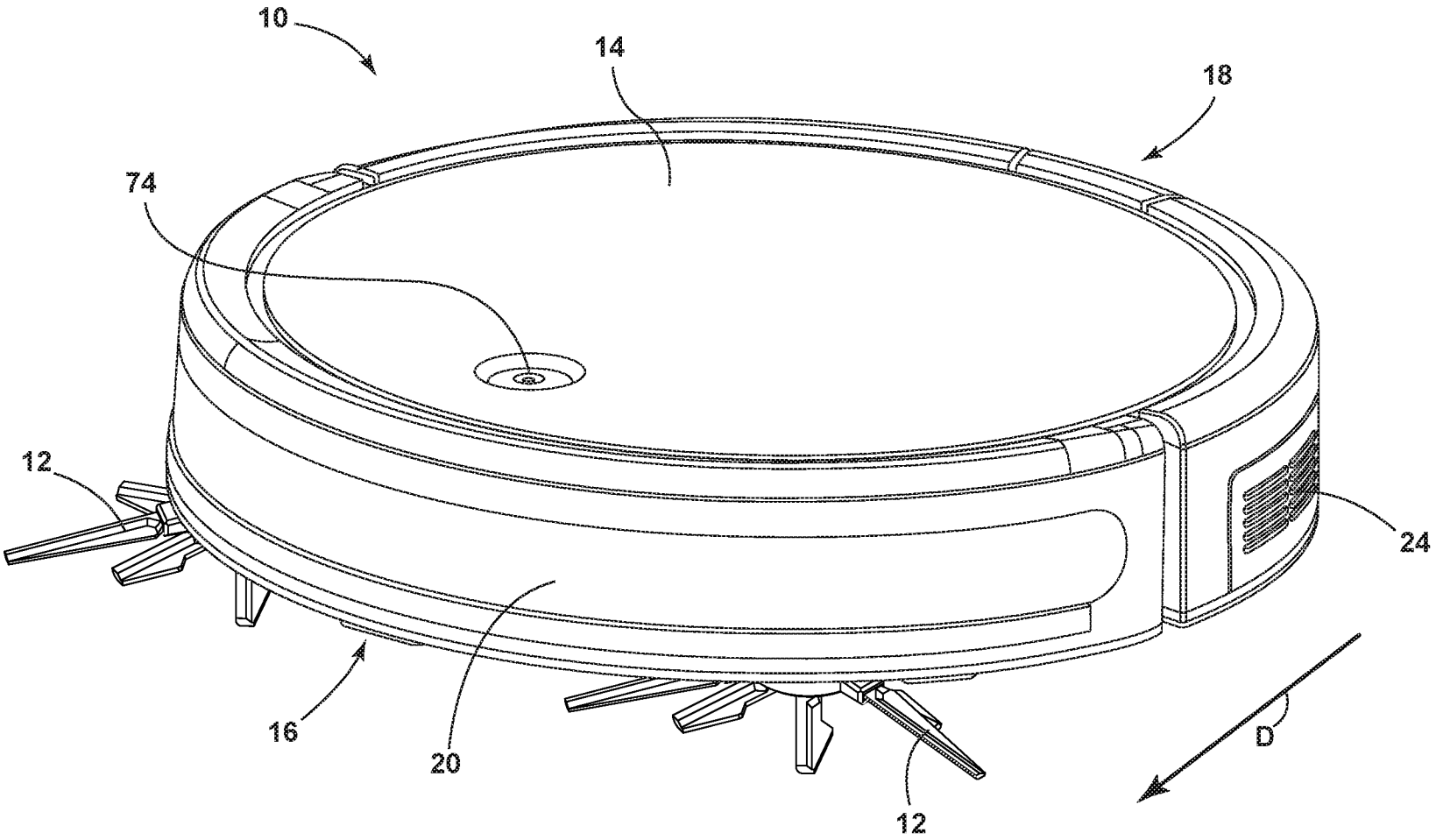
FIG. 1 is a top perspective view of an autonomous floor cleaner including one or more edge cleaning brushes according to one embodiment.

FIG. 1 is a perspective view of a surface cleaning apparatus according to one aspect of the present disclosure, shown as an autonomous surface cleaning apparatus or vacuum cleaning robot, and generally designated 10. As discussed in further detail below, the robot 10 is provided with various features and improvements, including at least one edge cleaning brush 12, described in further detail below. The at least one edge cleaning brush 12 can clean hard-to reach spaces such as along edges and in corners of a room, including edges or corners created by walls, baseboards, cabinetry, furniture, etc. As illustrated herein, the robot 10 mounts and/or carries the components of various functional systems of a deep cleaner in an autonomously moveable unit or housing 14, including components of a recovery or vacuum collection system for removing debris from a surface to be cleaned and storing the debris on-board the housing 14, and components of a drive system for autonomously moving the robot 10 over the surface to be cleaned. The term "debris" includes dirt, dust, soil, hair, stains, and other debris, unless otherwise noted.

As shown, the robot 10 can include a circular housing 14 with a first or forward end 16 and a second or rearward end 18. As used herein, "front" or "forward" and variations thereof are defined relative to the direction of forward travel of the robot 10, unless otherwise specified. The forward direction of travel is indicated in FIG. 1 by arrow D. The forward end 16 can be formed by a bumper 20. During a collision with an obstacle, the bumper 20 can shift or translate to register a detection of an object. Other shapes and configurations for the robot 10 are possible, including a D-shaped housing.

Figure 2:
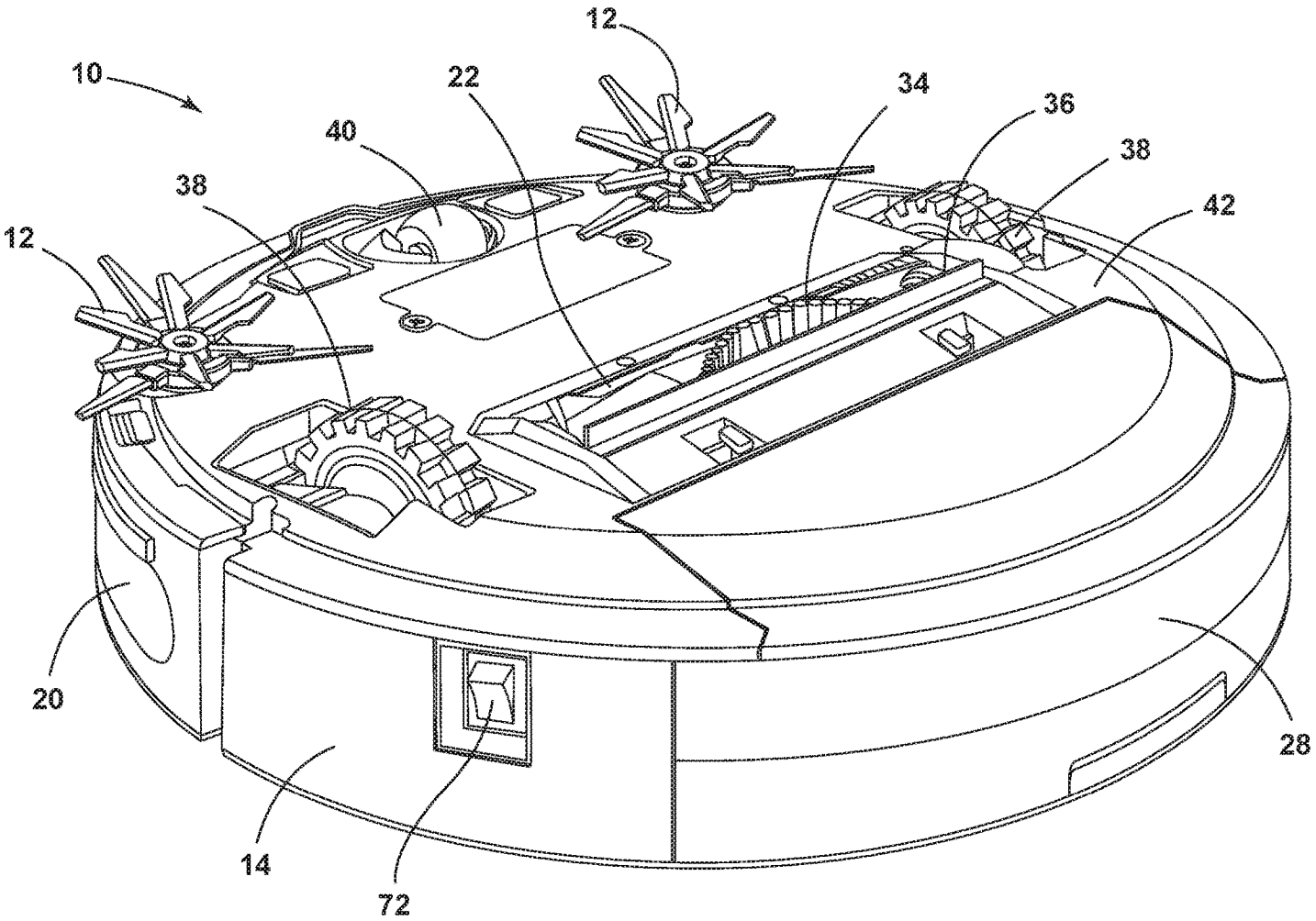
FIG. 2 is a bottom perspective view of the autonomous floor cleaner from FIG. 1.
Figure 3:
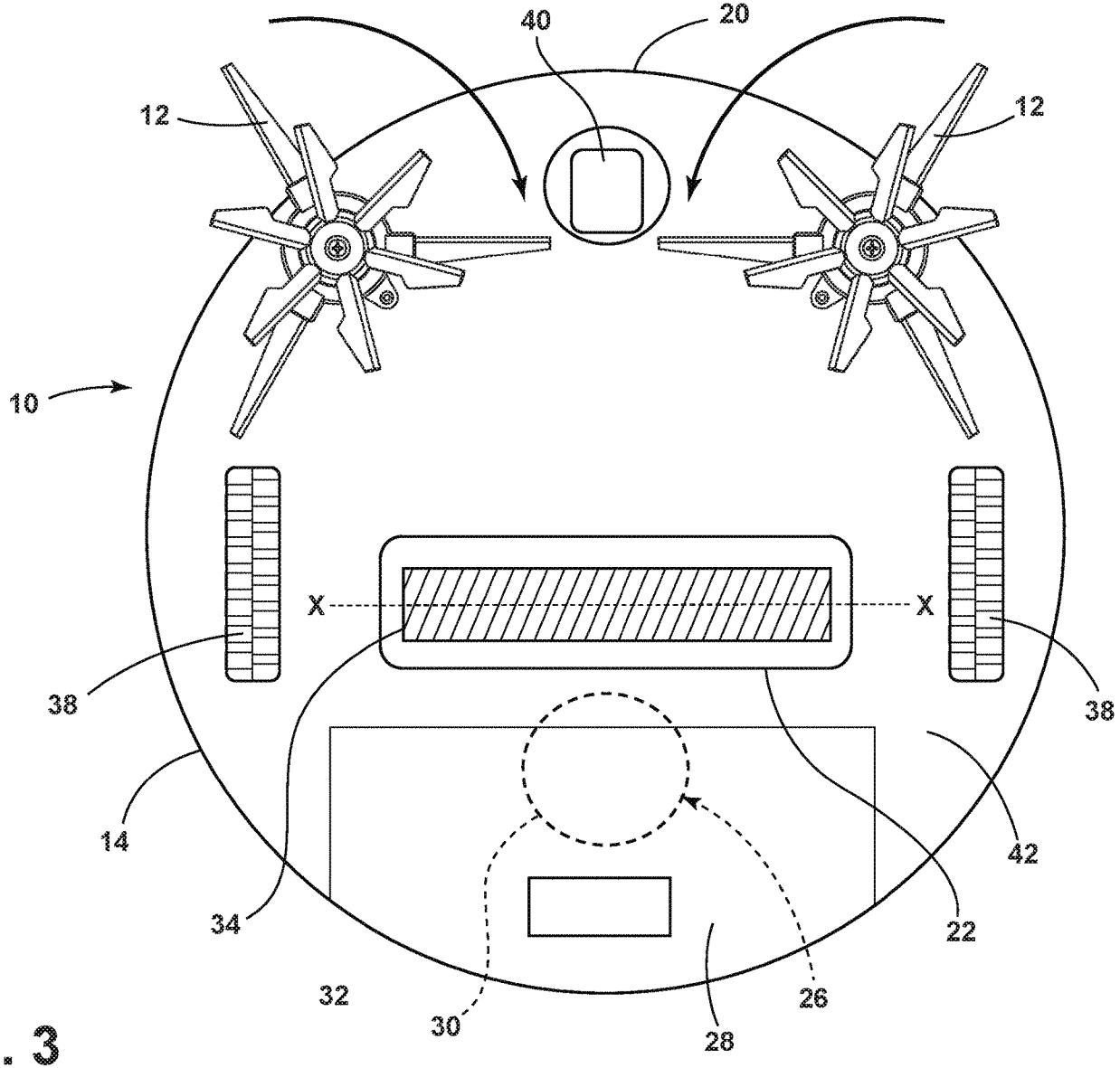
FIG. 3 is a bottom schematic view of the autonomous floor cleaner from FIG. 1.

With additional reference to FIGS. 2-3, the vacuum collection system can include a working air path or recovery pathway through the housing 14 having an air and debris inlet defined by a suction nozzle 22 and an air outlet defined by exhaust vents 24, a suction source 26 (shown in phantom line in FIG. 3) in fluid communication with the suction nozzle 22 for generating a working airstream through the recovery pathway, and a collection bin 28 for collecting dirt from the working airstream for later disposal.

The suction source 26 can be a motor/fan assembly carried by the unit 14, fluidly upstream of the air outlet, and can define a portion of the working air path. The suction source 26 can include a vacuum motor 30 located fluidly upstream of the vents 24, and can define a portion of the recovery pathway.

The collection bin 28 can also define a portion of the working air path and can comprise a separator (not shown) for separating debris from the working airstream. Some non-limiting examples of the separator include a cyclone separator, a filter screen, a foam filter, a HEPA filter, a filter bag, or combinations thereof. Optionally, a pre-motor filter and/or a post-motor filter (not shown) can be provided in the recovery pathway as well. The recovery pathway can further include various conduits, ducts, or tubes for fluid communication between the various components of the vacuum collection system. The vacuum motor 30 can be positioned downstream of the collection bin 28 in the recovery pathway. In other embodiments, the vacuum motor 30 may be located fluidly upstream of the collection bin 28.

The autonomous vacuum cleaner 10 can include a brush chamber 32 in which an agitator such as a brushroll 34 is mounted. The brushroll 34 is mounted for rotation about a substantially horizontal axis X, relative to the surface over which the unit 14 moves. A wiper blade 36 can be provided adjacent a trailing edge of the suction nozzle 22, behind the brushroll 34 in order to aid in dust collection. The suction nozzle 22 shown herein is positioned to confront the surface to be cleaned to remove debris from the surface. In other embodiments, the suction nozzle 22 can be positioned in close proximity to the brushroll 34 to collect debris directly from the brushroll 34. In the embodiment shown herein, the suction nozzle 22 is provided in the rear half of the housing 14. In other embodiments, the suction nozzle 22 can be provided in the front half of the housing 14.

The drive system can include drive wheels 38 for driving the housing 14 across a surface to be cleaned. The drive wheels 38 can be mounted at the approximate middle of the housing 14 between the forward and rearward ends 16, 18, and spaced laterally from each other. In addition to the drive wheels 38, the robot 10 can also include at least one caster 40 to maintain a minimum spacing between the surface to be cleaned and an underside 42 of the robot 10.

The robot 10 shown includes two edge cleaning brushes 12 on the underside 42 of the robot 10. The edge cleaning brushes 12 are mounted for rotation about a substantially vertical axis V, relative to the surface over which the unit 14 moves. In being substantially vertical, the rotational axis V can deviate up to 5 degrees from vertical, up to 10 degrees from vertical, up to 20 degrees from vertical, or up to 45 degrees from vertical. In other embodiments, the axis V of the edge cleaning brushes 12 is nonparallel or angled to the surface to be cleaned. For example, the axis V can be substantially perpendicular to the surface over which the robot 10 travels. In being substantially perpendicular, the rotational axis V can deviate up to 5 degrees from perpendicular, up to 10 degrees from perpendicular, up to 20 degrees from perpendicular, or up to 45 degrees from perpendicular.

In some embodiments, the rotational axis V is configured to maximize the contact area between the edge cleaning brushes 12. In the present embodiment, two edge cleaning brushes 12 are provided, and arranged at opposite lateral sides, i.e. left and right sides, of the housing 14 so that the robot 10 can edge clean on either side of the housing 14 without changing the orientation of the housing 14. In other embodiments, only one edge cleaning brush 12 is provided.

Advantageously, the edge cleaning brushes 12 sweep debris under the housing 14 and toward the suction nozzle 22. The direction of rotation for each edge cleaning brush 12 is indicated in FIG. 3 by arrow R. As is illustrated in FIG. 3, the edge cleaning brushes 12 can counter-rotate such that debris is swept towards the suction nozzle 22 by both brushes 12, and the suction source 26 can transport the debris to the collection bin 28. The left side edge cleaning brush 12 rotates in a clockwise direction as viewed from bottom. The right side edge cleaning brush 12 rotates in a counterclockwise direction as viewed from bottom. In one example, at least a portion of the edge cleaning brushes 12 extend beyond a periphery of the housing 14 such that debris adjacent the robot 10 can be swept toward the suction nozzle 22. In the embodiment shown herein, the edge cleaning brushes 12 are mounted at the forward end 16 of the robot 10, forwardly of the suction nozzle 22, and sweep debris toward the center and rear of the housing 14, i.e. toward the suction nozzle 22. The edge cleaning brushes 12 are also mounted forwardly of the brushroll 34 and drive wheels 38. In other embodiments, the edge cleaning brushes 12 can be mounted at the rearward end 18 of the robot 10, along only the left side of the robot 10 or along only the right side of the robot 10.

The direction of rotation may optionally be controlled based on the driving direction of the robot 10. Where the robot 10 is travelling in the forward direction D, the edge cleaning brushes 12 may rotate as shown in FIG. 3. Where the robot 10 is traveling in reverse, the edge cleaning brushes 12 may rotate in opposite directions.

The speed of rotation of the edge cleaning brushes 12 may optionally be controlled based various inputs. Some non-limiting examples of inputs include the cleaning mode of the robot 10, input from the sensors 80-94, input from a user via the user interface 66, or input from the user via remote user terminal, such as smartphone executing an application for control of the robot 10.

The edge cleaning brush 12 may comprise one or more different agitation or cleaning elements configured to brush, sweep, dust, mop, or otherwise move debris on the surface to be cleaned. Some non-limiting examples of cleaning elements for the edge cleaning brush 12 comprise blades, bristles, paddles, blades, flaps, microfiber material, fabric, dusting pads, and the like.

In other embodiments of the robot 10, the collection system can be configured as a sweeping or mechanical collection system that mechanically collects dirt and liquid without the use of suction, such as by the action of the brushroll 34 and edge cleaning brushes 12 mechanically propelling dirt directly into the collection bin 28. In such an embodiment, the edge cleaning brushes 12 can sweep debris under the housing 14 and toward a debris inlet on the housing 14.

In yet another alternative or additional collection mechanism, the robot 10 can include a mopping or dusting assembly for removing moistened dirt and other debris from the surface to be cleaned. Such a mopping or dusting assembly can optionally include at least one mopping or dusting pad and one or more edge cleaning brushes 12 that can sweep debris under the housing 14 and toward the pad. The pad can be stationary or rotatable.

Figure 4:
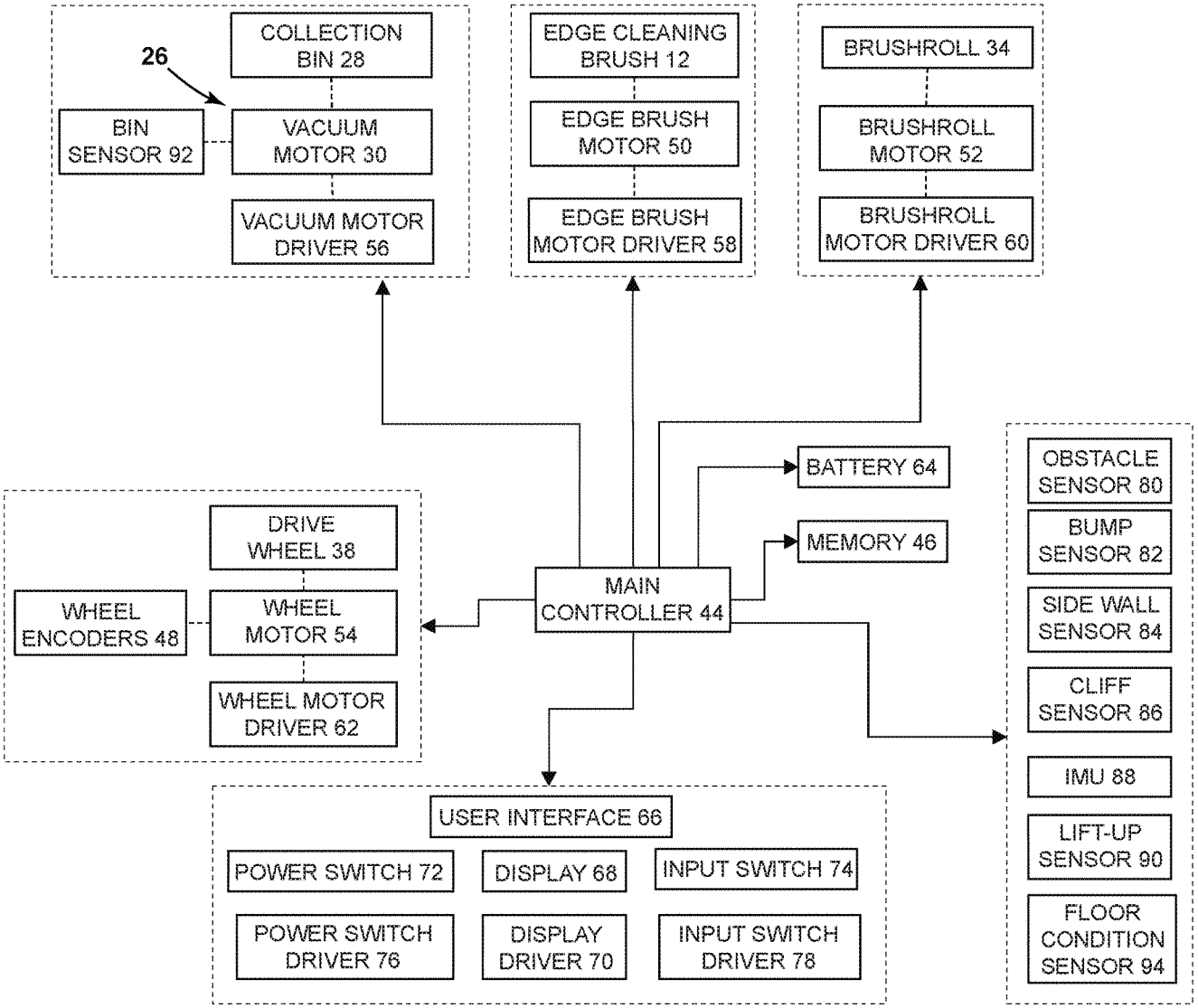
FIG. 4 is a schematic view of the autonomous floor cleaner from FIG. 1, illustrating functional systems in accordance with various aspects described herein.

FIG. 4 is a schematic view of various functional systems of the robot 10. A controller 44 is operably coupled with the various function systems of the robot 10 for controlling its operation. The controller 44 can be a microcontroller unit (MCU) that contains at least one central processing unit (CPU).

A navigation/mapping system can be provided in the robot 10 for guiding the movement of the robot 10 over the surface to be cleaned, generating and storing maps of the surface to be cleaned, and recording status or other environmental variable information. The controller 44 can receive input from the navigation/mapping system or from a remote device such as a smartphone (not shown) for directing the robot 10 over the surface to be cleaned. The navigation/mapping system can include a memory 46 that can store any data useful for navigation, mapping or conducting a cycle of operation, including, but not limited to, maps for navigation, inputs from various sensors that are used to guide the movement of the robot 10, etc. For example, wheel encoders 48 can be placed on the drive wheels 38 to measure a distance traveled by the robot 10. The distance measurement can be provided as input to the controller 44. An artificial barrier system (not shown) can optionally be provided with the robot 10 for containing the robot 10 within a user-determined boundary.

The drive system can receive inputs from the controller 44 for driving the robot 10 across a floor, based on inputs from the navigation/mapping system for the autonomous mode of operation or based on inputs from a smartphone, tablet, or other remote device for the manual mode of operation. The drive wheels 38 can be driven in a forward or reverse direction to move the unit forwardly or rearwardly. Furthermore, the drive wheels 38 can be operated simultaneously at the same rotational speed for linear motion or independently at different rotational speeds to turn the robot 10 in a desired direction.

In an autonomous mode of operation, the robot 10 can be configured to travel in any pattern useful for cleaning including boustrophedon or alternating rows (that is, the robot 10 travels from right-to-left and left-to-right on alternate rows), spiral trajectories, etc., while cleaning the floor surface, using input from various sensors to change direction or adjust its course as needed to avoid obstacles. In a manual mode of operation, movement of the robot 10 can be controlled using a mobile device such as a smartphone or tablet.

The robot 10 can include any number of motors useful for performing locomotion and cleaning. In one example, in addition to the vacuum motor 30, brush motors 50, 52 can be provided within the robot 10 to drive the edge cleaning brushes 12 and brushroll 34, respectively and wheels motors 54 can be provided within the robot 10 to drive the drive wheels 38. Each motor 50, 52, 54 can be coupled with a respective driven implement (i.e. edge cleaning brushes 12, brushroll 34, or wheel 38) by a transmission, which may include a gear train assembly or another suitable transmission. In another example, one shared motor can rotate the brushroll 34 and generate a partial vacuum at the suction nozzle 22. In still another example, one shared motor can rotate both drive wheels 38. In yet another example, one shared motor can rotate the brushroll 34 and drive one or more of the edge cleaning brushes 12.

A vacuum motor driver 56, edge brush motor driver 58, brushroll motor driver 60, and wheel motor driver 62 can be provided for controlling the respective motors. The motor drivers can act as an interface between the controller 44 and their respective motor. The motor drivers 56-62 can also be an integrated circuit chip (IC). It is also contemplated that a single wheel motor driver 62 can control multiple wheel motors 54 simultaneously.

The motor drivers can be electrically coupled to a battery management system that includes a built-in rechargeable battery 64 (or battery pack). In one example, the battery 64 can include lithium ion batteries. Charging contacts for the battery 64 can be provided on an exterior surface of the robot 10. A docking station (not shown) can be provided with corresponding charging contacts that can mate to the charging contacts on the exterior surface of the robot 10. In another embodiment, the battery 64 can be removed from the robot 10 for charging.

The controller 44 is further operably coupled with a user interface (UI) 66 on the robot 10 for receiving inputs from a user. The user interface 66 can be used to select an operation cycle for the robot 10 or otherwise control the operation of the robot 10. The user interface 66 can have a display 68, such as an LED display, for providing visual notifications to the user. A display driver 70 can be provided for controlling the display 68, and acts as an interface between the controller 44 and the display 68. The display driver 70 may be an IC. The robot 10 can further be provided with a speaker (not shown) for providing audible notifications to the user. The robot 10 can further be provided with one or more cameras or stereo cameras (not shown) for acquiring visible notifications from the user. In this way, the user can communicate instructions to the robot 10 by gestures. For example, the user can wave their hand in front of the camera to instruct the robot 10 to stop or move away.

The user interface 66 can further have one or more input controls or buttons that provide input to the controller 44 to control the operation of various components of the robot 10. In one example, a power switch button 72 on the housing 12 controls activation of the robot 10 and a separate input button 74 on the housing 12 controls the start, stop, and docking functions of the robot 10. Switch drivers 76, 78 can be provided for controlling switches associated with the buttons 72, 74, and act as an interface between the controller 44 and the buttons 72, 74.

The controller 44 can further be operably coupled with various sensors for receiving input about the environment and can use the sensor input to control the operation of the robot 10. The sensors can detect features of the surrounding environment of the robot 10 including, but not limited to, walls, floors, chair legs, table legs, footstools, pets, consumers, and other obstacles. The sensor input can further be stored in the memory or used to develop maps for navigation. Some exemplary sensors are illustrated in FIG. 4, and described below, although it is understood that not all sensors shown may be provided, additional sensors may be provided, and that all of the possible sensors can be provided in any combination.

In one non-limiting example, the robot 10 can include obstacle sensors 80 determining the position of the robot 10, such as a stereo camera in a non-limiting example, for distance and position sensing. The obstacle sensors 80 can be mounted to the housing 14 of the robot 10, such as at the front of the housing 14, to determine the distance to obstacles in front of the robot 10. Input from the obstacle sensors 80 can be used to slow down or adjust the course of the robot 10 when objects are detected.

Bump sensors 82 can also be provided for determining front or side impacts to the robot 10. The bump sensors 82 may be integrated with the housing 14, such as with a bumper 20. Output signals from the bump sensors 82 provide inputs to the controller 44 for selecting an obstacle avoidance algorithm.

One or more side wall sensor 84 (also known as a wall following sensor) can also be located near one or more sides of the housing 14 and provide distance feedback so that the robot 10 can follow near a wall without contacting the wall. In one embodiment, input from the side wall sensor 84 can be sued to active one or more of the edge cleaning brushes 12. For example, when a wall or other obstacle is detected by the side wall sensor, the brush motor 50 is activated and when a wall or other obstacle is not detected by the side wall sensor, the brush motor 50 is deactivated. In other embodiments, the brush motor 50 can be continuously active during operation of the robot 10.

One or more cliff sensors 86 can also be located on the underside of the housing 14 and provide distance feedback so that the robot 10 can avoid excessive drops down stairwells, ledges, etc. The side wall and cliff sensors 84, 86 can be optical, mechanical, or ultrasonic sensors, including reflective or time-of-flight sensors.

The robot 10 can also include an inertial measurement unit (IMU) 88 to measure and report the robot's acceleration, angular rate, or magnetic field surrounding the robot 10, using a combination of at least one accelerometer, gyroscope, and, optionally, magnetometer or compass. The IMU 88 can be an integrated inertial sensor located on the controller 44 and can be a nine-axis gyroscope or accelerometer to sense linear, rotational or magnetic field acceleration. The IMU 88 can use acceleration input data to calculate and communicate change in velocity and pose to the controller 44 for navigating the robot 10 around the surface to be cleaned.

The robot 10 can further include one or more lift-up sensors 90 which detect when the robot 10 is lifted off the surface to be cleaned e.g. if a user picks up the robot 10. This information is provided as an input to the controller 44, which can halt operation of the motors 30, 56, 58, 60, 62 in response to a detected lift-up event. The lift-up sensors 90 may also detect when the robot 10 is in contact with the surface to be cleaned, such as when the user places the robot 10 back on the ground. Upon such input, the controller 44 may resume operation of the motors.

The robot 10 can optionally include a bin sensor 92 for detecting a characteristic or status of the collection bin 28. In one example, one or more pressure sensors for detecting the weight of the collection bin 28 can be provided. In another example, one or more magnetic sensors for detecting the presence of the collection bin 28 can be provided. This information is provided as an input to the controller 44, which may prevent operation of the robot 10 until the collection bin 28 is emptied and/or properly installed, in non-limiting examples. The controller 44 may also direct the display 68 to provide a notification to the user that the collection bin 28 is full and/or missing.

The robot 10 can further include one or more floor condition sensors 94 for detecting a condition of the surface to be cleaned. For example, the robot 10 can be provided with an infrared (IR) dirt sensor, a stain sensor, an odor sensor, or a wet mess sensor. The floor condition sensors 94 provide input to the controller that may direct operation of the robot 10 based on the condition of the surface to be cleaned, such as by selecting or modifying a cleaning cycle. Optionally, the floor condition sensors 94 can also provide input for display on a smartphone.

Figure 5:
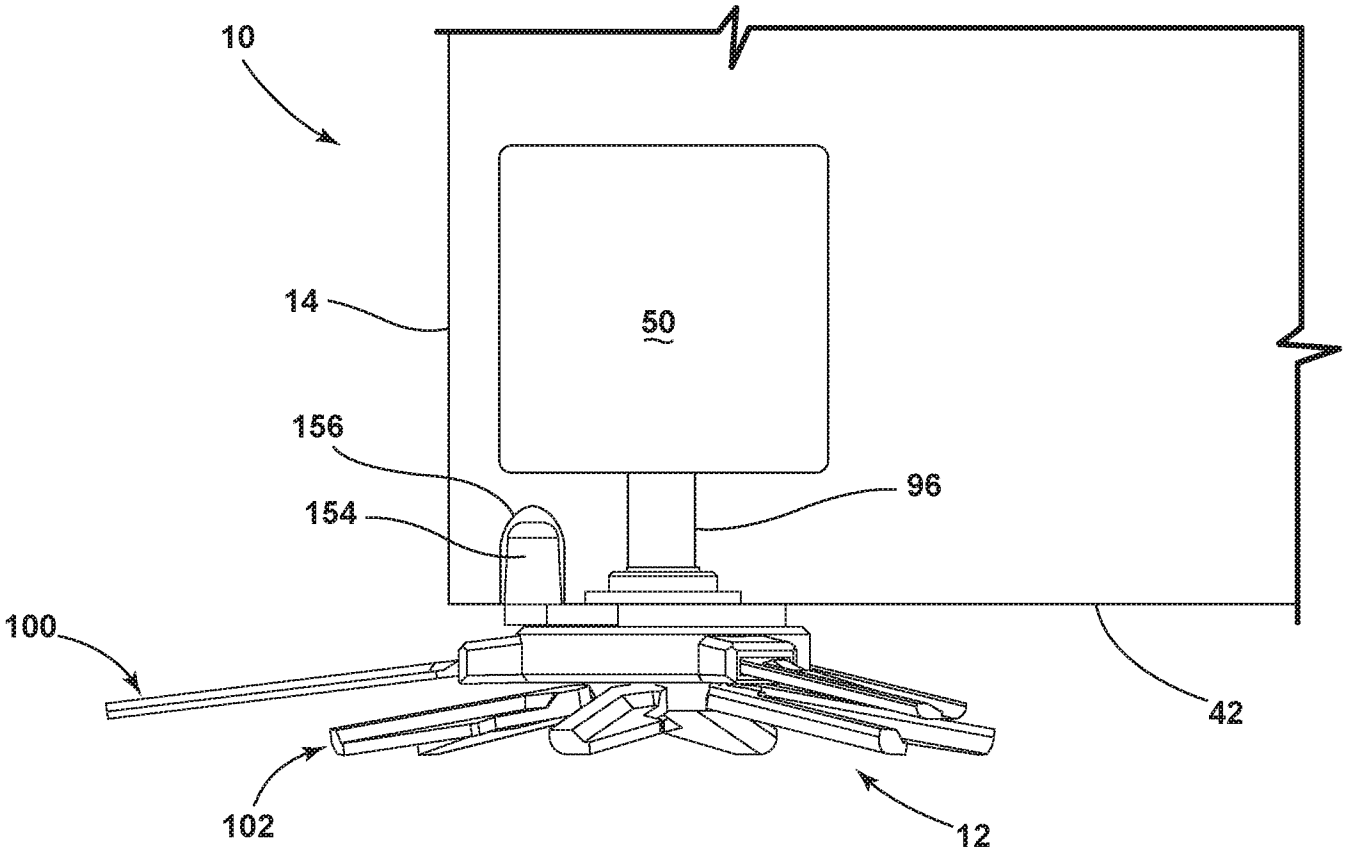
FIG. 5 is a schematic side view of a portion of the autonomous floor cleaner from FIG. 1, illustrating an edge cleaning brush drivingly connected with a brush motor.
Figure 7:
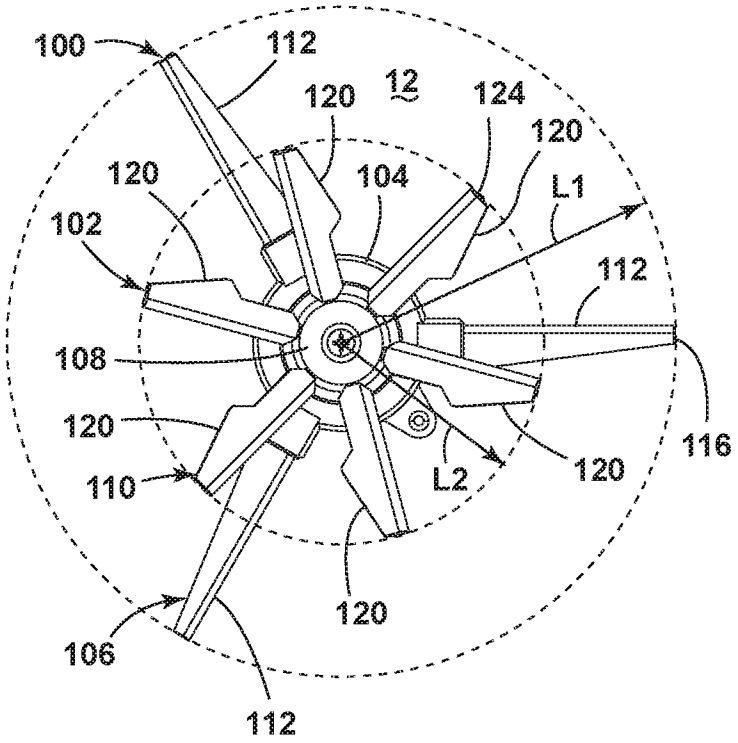
FIG. 7 is a bottom view of the edge cleaning brush from FIG. 6.

Referring to FIG. 5, the edge cleaning brush 12 is coupled with the brush motor 50 via a drive shaft 96 of the brush motor 50 that outputs a driving force to the edge cleaning brush 12 and rotates at a predetermined speed. The brush motor 50 can be housed within the housing 14 or can be housed within a separate motor housing (not shown) that is formed with or otherwise coupled to the housing 14. The brush motor 50 is configured to drive at least a portion of the edge cleaning brush 12 about a rotational axis V, relative to the housing 14, with the drive shaft 96 defining the axis of rotation V of the edge cleaning brush 12. The edge cleaning brush 12 can be fixedly or removably mounted to the shaft 96 of the brush motor 50. With a removable mounting, the edge cleaning brush 12 can be an aftermarket or replacement component for existing edge cleaning brushes on robots and other floor cleaning devices.

FIGS. 6-11 show details of one embodiment of the edge cleaning brush 12. The edge cleaning brush 12 can comprise an assembly including multiple cleaning implements, including a first cleaning implement 100 and a second cleaning implement 102 configured to rotate at different velocities. While two cleaning implements are shown, additional cleaning implements can be included in other embodiments of the edge cleaning brush 12, and the additional cleaning implements can be configured to rotate at the same or different velocities as the first and second cleaning implements 100, 102.

The first cleaning implement 100 includes a first rotational body 104 configured to rotate with respect to the housing 14 of the robot 10 and a first cleaning element 106 coupled with the first rotational body 104 for rotation therewith. By being "coupled with" the rotational body 104, the first cleaning element 106 can be attached to, formed with, or otherwise suitably joined to the rotational body 104 for rotation therewith. The first cleaning element 106 is configured to brush, sweep, dust, mop, or otherwise move debris on the surface to be cleaned. As discussed above with respect to FIG. 3, the first cleaning element 106 can move debris on the surface to be cleaned toward the suction nozzle 22 or other debris inlet on the housing 14.

The second cleaning implement 102 includes a second rotational body 108 configured to rotate with respect to the housing 14 of the robot 10 and a second cleaning element 110 coupled with the second rotational body 108 for rotation therewith. By being "coupled with" the rotational body 108, the second cleaning element 110 can be attached to, formed with, or otherwise suitably joined to the rotational body 108 for rotation therewith. The second cleaning element 110 is configured to brush, sweep, dust, mop, or otherwise move debris on the surface to be cleaned. As discussed above with respect to FIG. 3, the second cleaning element 110 can move debris on the surface to be cleaned toward the suction nozzle 22 or other debris inlet on the housing 14.

The first and second rotational bodies 104, 108 can be concentrically aligned along the rotational axis V of the edge cleaning brush 12. In one embodiment, the rotational bodies 104, 108 can be stacked, with the first rotational body 104 stacked on top of the second rotational body 108. With this stacked arrangement, the first cleaning element 106 can generally overlie the second cleaning element 110. In operation, at least a portion of each cleaning element 106, 110 can be in contact with the surface to be cleaned.

The first cleaning element 106 can comprises a set of blades 112 having a first length L1. The blades 112 can extend from a root 114 coupled with the rotational body 104 to a distal tip 116. Optionally, the rotational body 104 can comprise a peripheral surface 118 that is disposed radially outwardly from the rotational axis V, and the blades 112 can project radially with respect to the peripheral surface 118. The blades 112 can be spaced equally about the rotational axis V. For example, in the embodiment of the edge cleaning brush 12 shown, the first cleaning element 106 can comprise three blades 112 which are spaced approximately 120° from each other. Other blade numbers and spacing are possible.

The second cleaning element 110 can comprise a set of blades 120 having a second length L2. The blades 120 can extend from a root 122 coupled with the rotational body 108 to a distal tip 124. Optionally, the rotational body 108 can comprise a peripheral surface 126 that is disposed radially outwardly from the rotational axis V, and the blades 120 can project radially with respect to the peripheral surface 126. The blades 120 can be spaced equally about the rotational axis V. For example, in the embodiment of the edge cleaning brush 12 shown, the second cleaning element 110 can comprise six blades 120 which are spaced approximately 60° from each other. Other blade numbers and spacing are possible.

The blades 112, 120 can be semi-rigid elastomeric arms that are stiff enough to provide adequate movement of debris on the surface toward the suction nozzle 22, while also being flexible enough to not break when encountering obstacles in from the robot 10. One example of a suitable semi-rigid elastomeric material is urethane, optionally having a Shore A durometer of 60-90, inclusive. In other embodiments, other types of sweeping, dusting, or scrubbing blades can be used. In yet other embodiments, bristles, pads, or arms for sweeping, dusting, and/or scrubbing can be used instead of blades.

Figure 6:
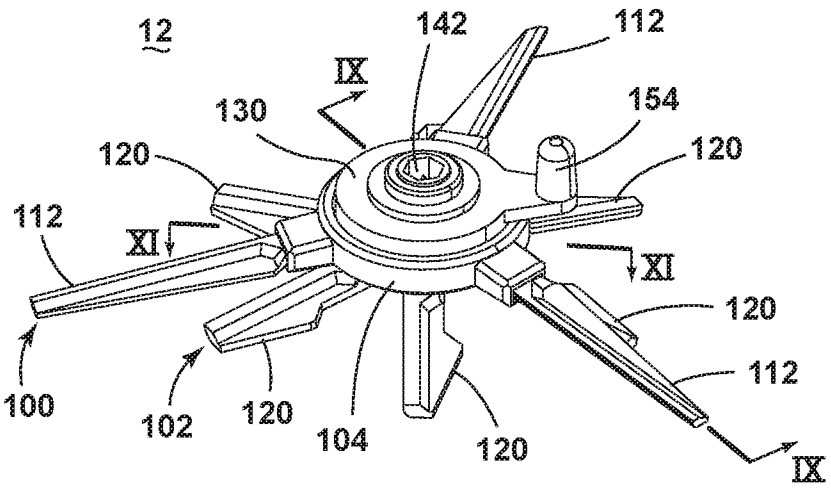
FIG. 6 is a perspective view of a first embodiment of an edge cleaning brush.
Figure 8:
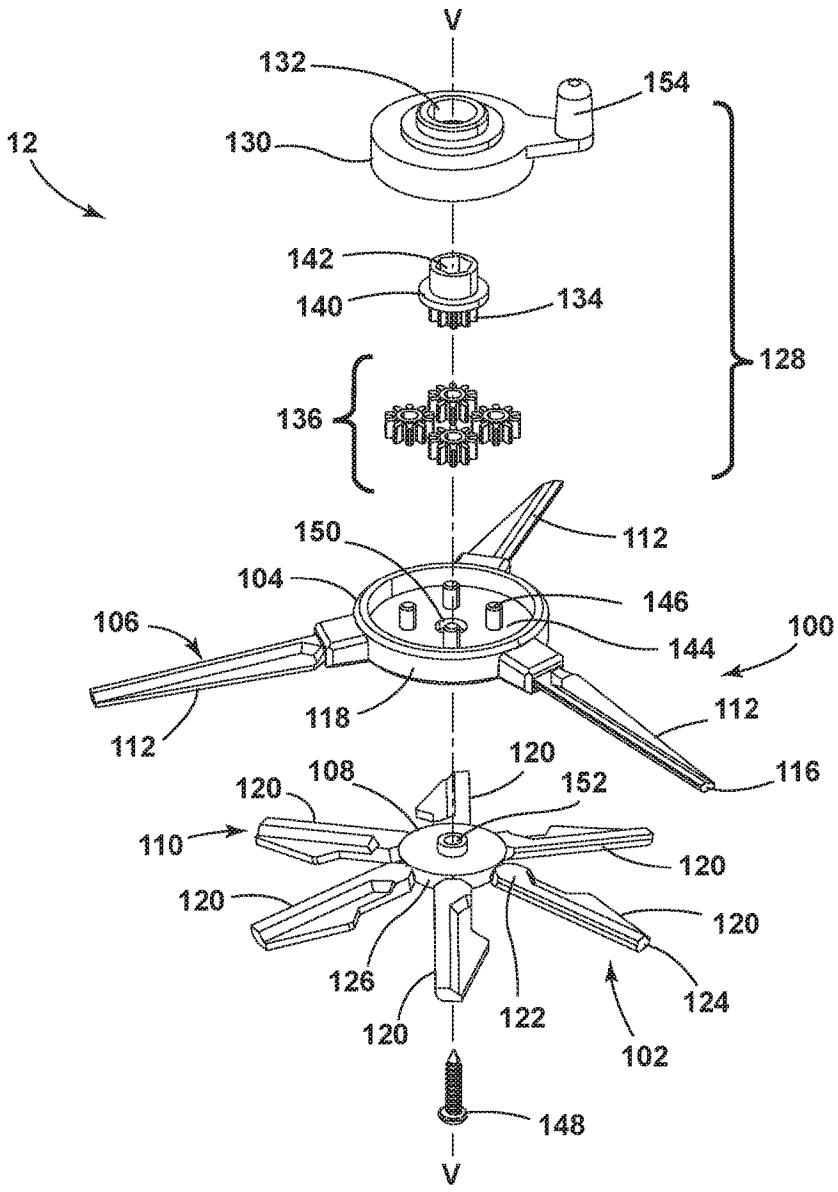
FIG. 8 is an exploded view of the edge cleaning brush from FIG. 6.
Figure 9:
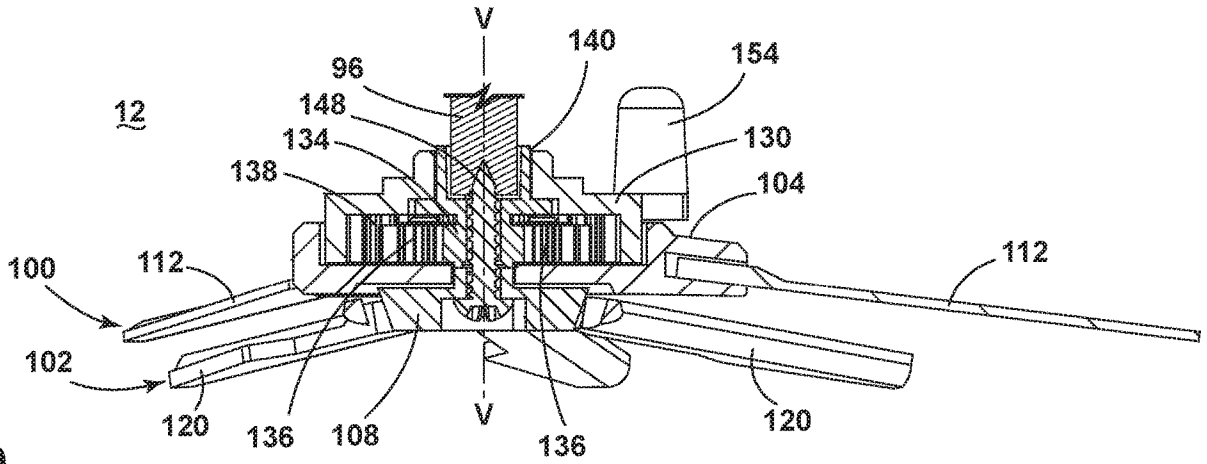
FIG. 9 is a sectional view of the edge cleaning brush taken through line IX-IX of FIG. 6.
Figure 11:
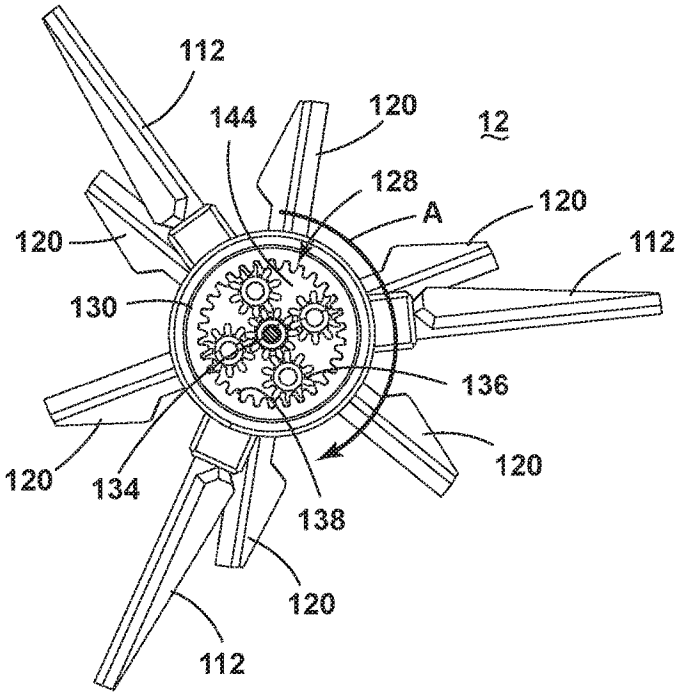
FIG. 11 is a sectional view of the edge cleaning brush taken through line XI-XI of FIG. 6.
Figure 10:
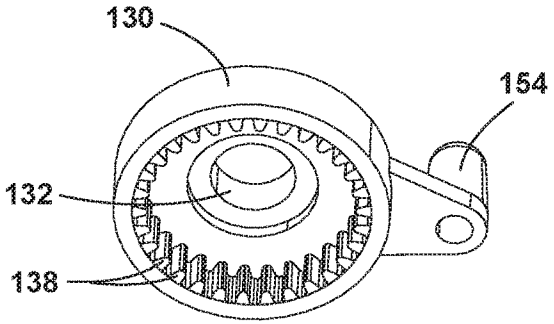
FIG. 10 is a bottom perspective view of a gear casing for the edge cleaning brush from FIG. 6.

The lengths L1, L2 of the blades 112, 120 can be different. For example, the second set of blades 120 can have a length L2 that is less than the length L1 of the first set of blades 112. As shown in FIG. 6, the lengths L1, L2 of the blades 112, 120 can be an effective length measured as the distance between the axis of rotation of the edge cleaning brush 12 and the distal tip 116, 124 of the blades 112, 120. The actual length of each blade 112, 120, or the root-to-tip length, may vary from the effective length L1, L2. It is also noted that the blades 112, 120 in each set are shown as having the same length, however in other embodiments of the edge cleaning brush 12 the length of individual blades 112, 120 within one set may vary.

In one embodiment, the first cleaning implement 100 is configured to rotate at a first velocity and the second cleaning implement 102 configured to rotate at a second velocity that is greater than the first velocity.

Referring to FIGS. 8-11, optionally, one or more of the cleaning implements 100, 102 of the edge cleaning brush 12 is coupled with the brush motor 50 by a transmission, which may include a gear system or a gear train assembly. In the embodiment shown herein, the first cleaning implement 100 is coupled with the brush motor 50 by an epicyclic or planetary gear system 128 that modifies the driving force produced by the brush motor 50. For example, the brush motor shaft 96 (FIG. 9) of may rotate at a particular predetermined speed to output a driving force, and the planetary gear system 128 can modify the rotational speed and apply the reduced rotational speed the first cleaning implement 100. In the present embodiment, the second cleaning implement 102 is directly connected with the brush motor shaft 96, or is otherwise operably coupled with the brush motor shaft 96 so that the second cleaning implement 102 rotates at the same speed as the shaft 96. While a planetary gear system is shown, other non-planetary gear arrangements are possible.

The planetary gear system 128 may be provided on a top side of the rotational body 104 within a gear casing 130. The gear casing 130 includes an aperture 132 through which the brush motor shaft 96 extends to connect with the planetary gear system 128 and the second cleaning implement 102. The planetary gear system 128 may include one or more stages. In the embodiment shown, the planetary gear system 128 includes one stage enclosed within the gear casing 130. The planetary gear system 128 can alternatively be housed within a casing that is formed with or otherwise coupled to the housing 14 or motor housing (not shown).

The gearbox for the edge cleaning brush 12, i.e. the planetary gear system 128 and its casing 130, can be disposed internal or external to the housing 14 of the robot 10. With an external gearbox, the edge cleaning brush 12 can be an aftermarket or replacement component for existing edge cleaning brushes on robots and other floor cleaning devices. With an internal gearbox, the rotational bodies 104, 108 for the first and second cleaning implements 106, 110 can be brackets that are fixedly or removably mounted to the appropriate portions of the gearbox to move at different speeds.

The planetary gear system 128 includes a sun gear 134, a plurality of planetary gears 136 meshed with the sun gear 134 and revolving around the sun gear 134, and an outer ring gear 138 meshed with the planetary gears 136 and fixed to the gear casing 130.

The sun gear 136 is fixed with the shaft 96 of the brush motor 50, and is configured to rotate on the axis V when driven by the brush motor 50. The sun gear 136 can include a hub 140 with a hub opening 142, which receives an end of the drive shaft 96. The hub 140 rotates within the aperture 132 on the gear casing 130. To maintain the angular relationship between the sun gear 136 and the shaft 96, the shaft 96 can comprise a hexagonal cross-section and the hub opening 142 can comprise a corresponding hexagonal shape. Other configurations for the cross-section of the shaft 96 and the hub opening 142 are possible. Alternatively, the connection can comprise a spline or keyway-and-key coupling between the shaft 96 and the sun gear 136.

The planetary gears 136 roll around the sun gear 134 on the inside of the ring gear 138, which is fixed and non-rotatable, as described in further detail below. In other planetary system configurations, the ring gear 138 can be non-fixed and rotatable, and can comprise the rotational body on which the cleaning elements 106, 110 are disposed.

In the embodiment shown, four planetary gears 136 are provided, although other numbers of planetary gears 136 are possible. The first rotational body 104 comprises a carrier 144 for the planetary gears 136. The carrier 144 for can be formed by or otherwise coupled with the first rotational body 104. In the embodiment shown, the carrier 144 is a surface that extends to the peripheral surface 118 of the rotational body 104 on which the blades 120 are disposed. The carrier 144 includes axles 146 supporting the planetary gears 136 in fixed locations on the rotational body 104. The planetary gears 136 can turn on the axles 146, and as both the sun gear 134 and ring gear 138 are constrained on the axis V, the rolling motion of the planetary gears 136 around the sun gear 134 drives the carrier 144, and therefore the first rotational body 104, to rotate. In another embodiment, rather than one cleaning implement 100 being driven by the rolling motion of the planetary gears 136, a cleaning implement can be coupled with each planetary gear 136 so that the rolling motion of the planetary gears 136 around the sun gear 134 drives multiple cleaning implements to rotate.

As briefly discussed above, the rotational body 108 of the second cleaning implement 102 can be connected with the brush motor shaft 96 so that the second cleaning implement 102 rotates at the same speed as the shaft 96. As shown herein, in one embodiment, the rotational body 108 can be connected with the shaft 96 via a mechanical fastener or screw 148. The fastener or screw 148 can fasten to the brush motor shaft 96, the sun gear 134, or both in order to drivingly connect the rotational body 108 with the brush motor 50. The rotational bodies 104, 108 can include aligned apertures 150, 152, respectively through which the fastener or screw 148 extends to connect the rotational body 108 with the brush motor shaft 96 and/or the sun gear 134. Other configurations for operably connecting the brush motor 50 and the second cleaning implement 102 are possible.

The edge cleaning brush 12 can comprise at least one anti-rotation feature for preventing rotation of the ring gear 138 relative to the housing 14 of the robot 10. The anti-rotation feature can comprise an arm or pin 154 on the gear casing 130 which is received within a corresponding aperture 156 (FIG. 5) on the housing 14 to interlock the gear casing 130 with the housing 14. When the pin 154 operably engages with the aperture 156, the gear casing 130, and therefore ring gear 138, cannot rotate relative to the housing 14. Other anti-rotation feature for interlocking the gear casing 130 and housing 14 are possible, including having a plurality of anti-rotation features. For example, multiple pins 154 can protrude upwardly from the gear casing 130, and can lock into corresponding apertures 156 on the housing 14. The pins 154 can be disposed symmetrically about the axis V, which can distribute torque more evenly on the gear casing 130.

When the sun gear 134 is driven by the motor 50 to rotate in a first direction A, the sun gear 134, in turn, drives the planetary gears 136 to roll around the sun gear 134 on the inside of the ring gear 138 in the first direction A. The planetary gears 136 also drive the carrier 144, and therefore the first cleaning implement 100, to rotate around the sun gear in the first direction A at a reduced speed. The two cleaning implements 100, 102 therefore move at different speeds, with the inner, shorter blades 112 moving at full speed, and the outer, longer blades 120 moving at a lower speed, such as at 25% speed of the drive shaft 96 with the planetary gear system 128 shown in the figures, which has a 4:1 gear ratio. In one example, the first cleaning implement 100 is driven at 60 to 200 rpm, inclusive, alternatively at 60 rpm, alternatively at 100 rpm, and the second cleaning implement 102 is driven at 180 to 800 rpm, inclusive, alternatively at 240 rpm, alternatively at 350 rpm.

The tangential velocity of the tips 116 of the first blades 112 may be at least as great as the tangential velocity of the tips 124 of the second blades 120. Edge brushes with only one tangential velocity, or tip speed may sweep fine dust effectively, but may cause scattering of large debris. Alternatively, the tip speed may be optimized to avoid scattering large debris, while sacrificing fine dust collection. The edge cleaning brush 12 disclosed herein comprises two separate tip speeds which helps achieve a highly effective sweeping performance, while still collecting large debris without scattering.

As described above, the planetary gear system 128 is configured to drive the first cleaning implement 100 at a slower speed than the speed at which the second cleaning implement 102 is rotated. Slowing down the rotation speed of the outer, longer blades 120, which avoids flinging debris outside the cleaning path of the robot 10. This also allows stiffer blades to be used.

Figure 13:
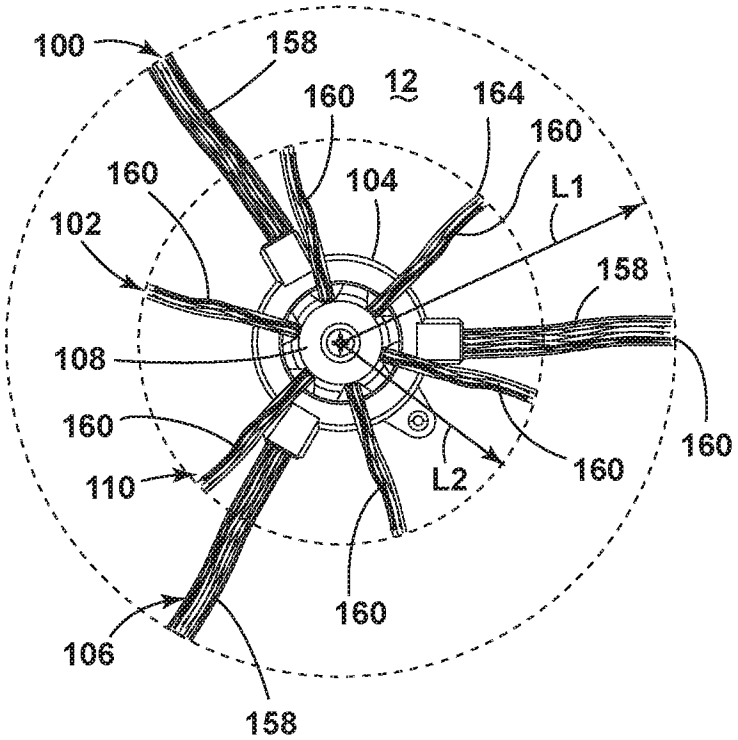
FIG. 13 is a bottom view of the edge cleaning brush from FIG. 12.
Figure 12:
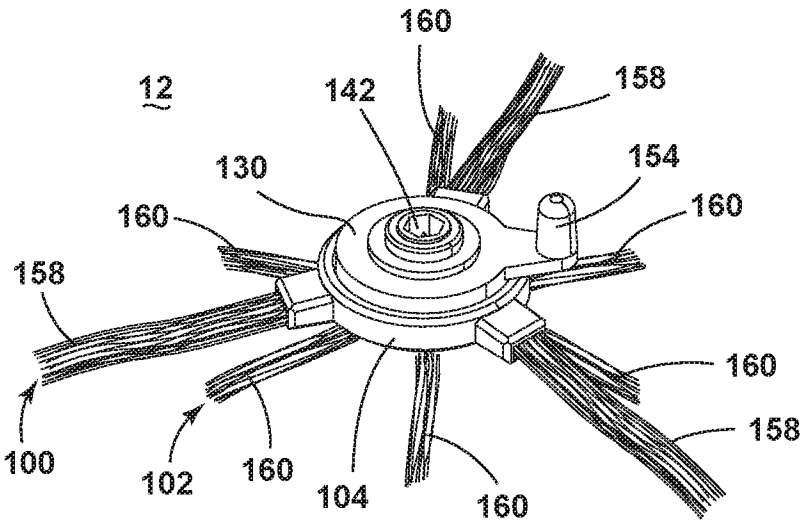
FIG. 12 is a perspective view of a second embodiment of an edge cleaning brush.

FIGS. 12-13 show details of another embodiment of the edge cleaning brush 12. The edge cleaning brush 12 can be substantially similar to the embodiment of the edge cleaning brush 12 described with respect to FIGS. 6-11, save for the cleaning elements 106, 110. Instead of blades, the cleaning elements 106, 110 can comprise bristles 158, 160, respectively. The distal ends or tips 162 of the first bristles 158 extend beyond the distal ends or tips 164 of the second bristles 160.

Figure 15:
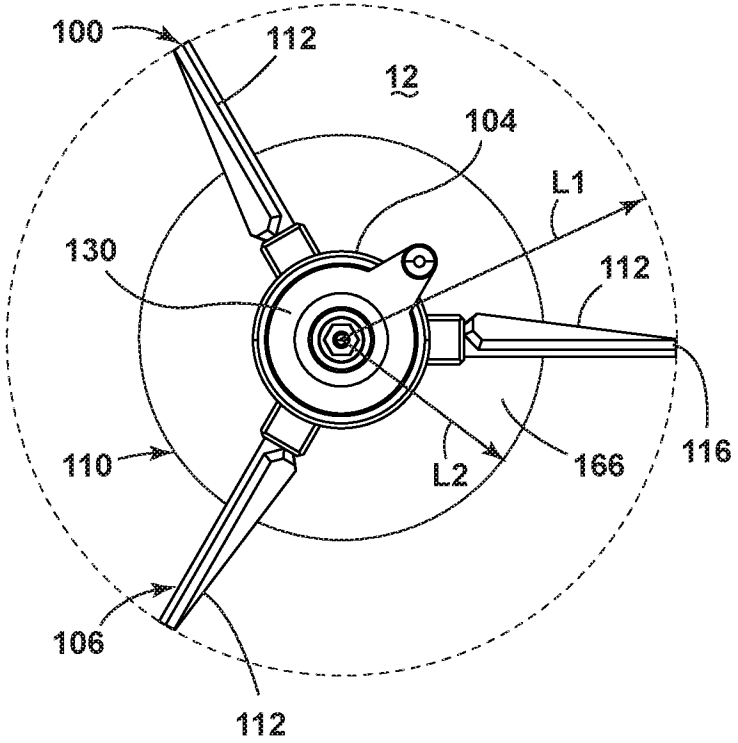
FIG. 15 is a top view of the edge cleaning brush from FIG. 14.
Figure 14:
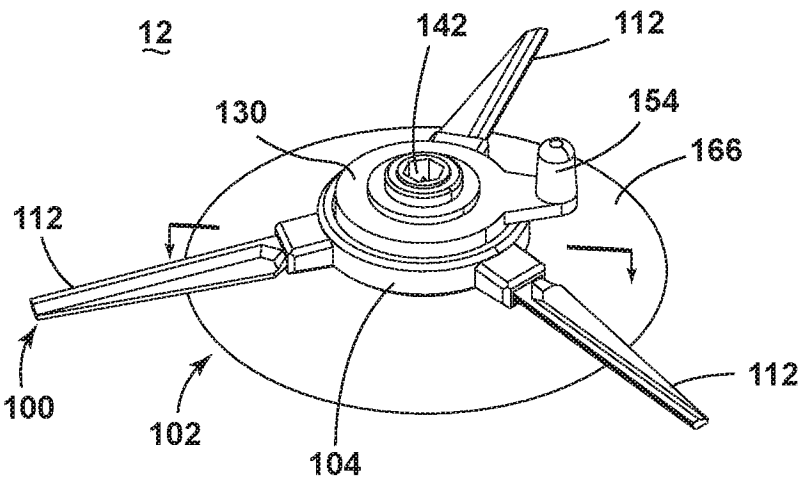
FIG. 14 is a perspective view of a third embodiment of an edge cleaning brush.

FIGS. 14-15 show details of yet another embodiment of the edge cleaning brush 12. The edge cleaning brush 12 can be substantially similar to the embodiment of the edge cleaning brush 12 described with respect to FIGS. 6-11, save for the second cleaning element 110. Instead of blades, the second cleaning element 110 can comprise a cleaning pad 166. The first cleaning element 106 can comprise blades 112 as shown, the distal end or tips 116 of the blades 112 extending beyond an outer edge 168 of the cleaning pad 166. Alternatively, the first cleaning element 106 can comprise bristles 160 as shown in FIG. 12-13, with the distal ends or tips 164 of the bristles 160 extending beyond the outer edge 168 of the cleaning pad 166. The cleaning pad 166 can be microfiber pad, or a wet scrubbing pad comprised of a different material.

Figure 16:
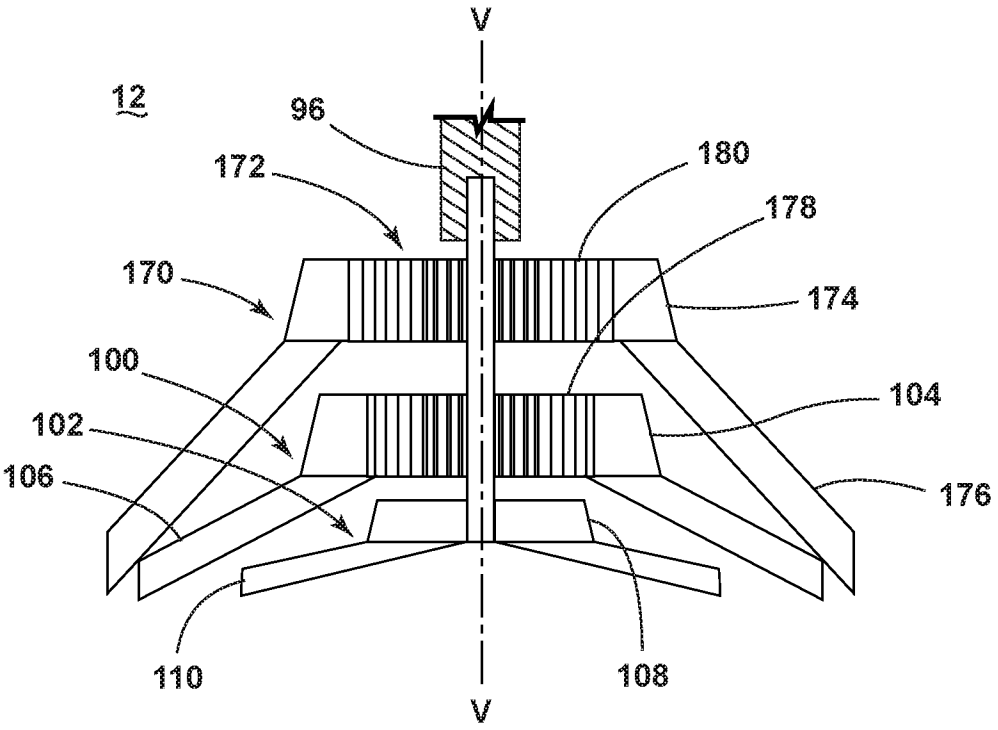
FIG. 16 is a schematic illustration of a fourth embodiment of an edge cleaning brush.

FIG. 16 is a schematic illustration of still another embodiment of the edge cleaning brush 12. The edge cleaning brush 12 can be substantially similar to the embodiment of the edge cleaning brush 12 described with respect to FIGS. 6-11, save for including a third cleaning implement 170 and a two-stage planetary gear system 172. The third cleaning implement 170 can be configured to rotate at a different velocity than the second cleaning implement 102, and at the same or a different velocity than the first cleaning implement 100.

The third cleaning implement 170 includes a third rotational body 174 configured to rotate with respect to the housing 14 of the robot 10 and a third cleaning element 176 coupled with the third rotational body 174 for rotation therewith. By being "coupled with" the rotational body 174, the third cleaning element 176 can be attached to, formed with, or otherwise suitably joined to the rotational body 174 for rotation therewith. The third cleaning element 176 is configured to brush, sweep, dust, mop, or otherwise move debris on the surface to be cleaned. For example, the third cleaning element 176, along with the first and second cleaning elements 106, 110 can move debris on the surface to be cleaned toward the suction nozzle 22 (FIG. 3) or other debris inlet on the housing 14.

The first, second, and third rotational bodies 104, 108, 174 can be concentrically aligned along the rotational axis V of the edge cleaning brush 12. In one embodiment, the rotational bodies 104, 108, 174 can be stacked, with the first rotational body 104 stacked on top of the second rotational body 108 and the third rotational body 174 stacked on top of the first rotational body 104. With this stacked arrangement, the first cleaning element 106 can generally overlie the second cleaning element 110 and the third cleaning element 176 generally overlie the first and second cleaning elements 106, 110. In operation, at least a portion of each cleaning element 106, 110, 176 can be in contact with the surface to be cleaned. The cleaning elements 106, 110, 176 can comprise blades, bristles, microfiber, cleaning pads, or another type of cleaning element.

The two-stage planetary gear system 172 includes a first planetary gear set 178 for the first cleaning implement 102, and can be substantially the same as the gear set described above with respect to FIGS. 8-11. Another planetary gear set 180 is provided for the third cleaning implement 170. The second cleaning implement 102 moves at the full speed of the drive shaft 96, the first cleaning implement 100 moves at a reduced speed as determined by the gear ratio of the first planetary gear set 178, and the third cleaning implement 170 moves at a reduced speed as determined by the gear ratio of the second planetary gear set 180.

Figure 17:
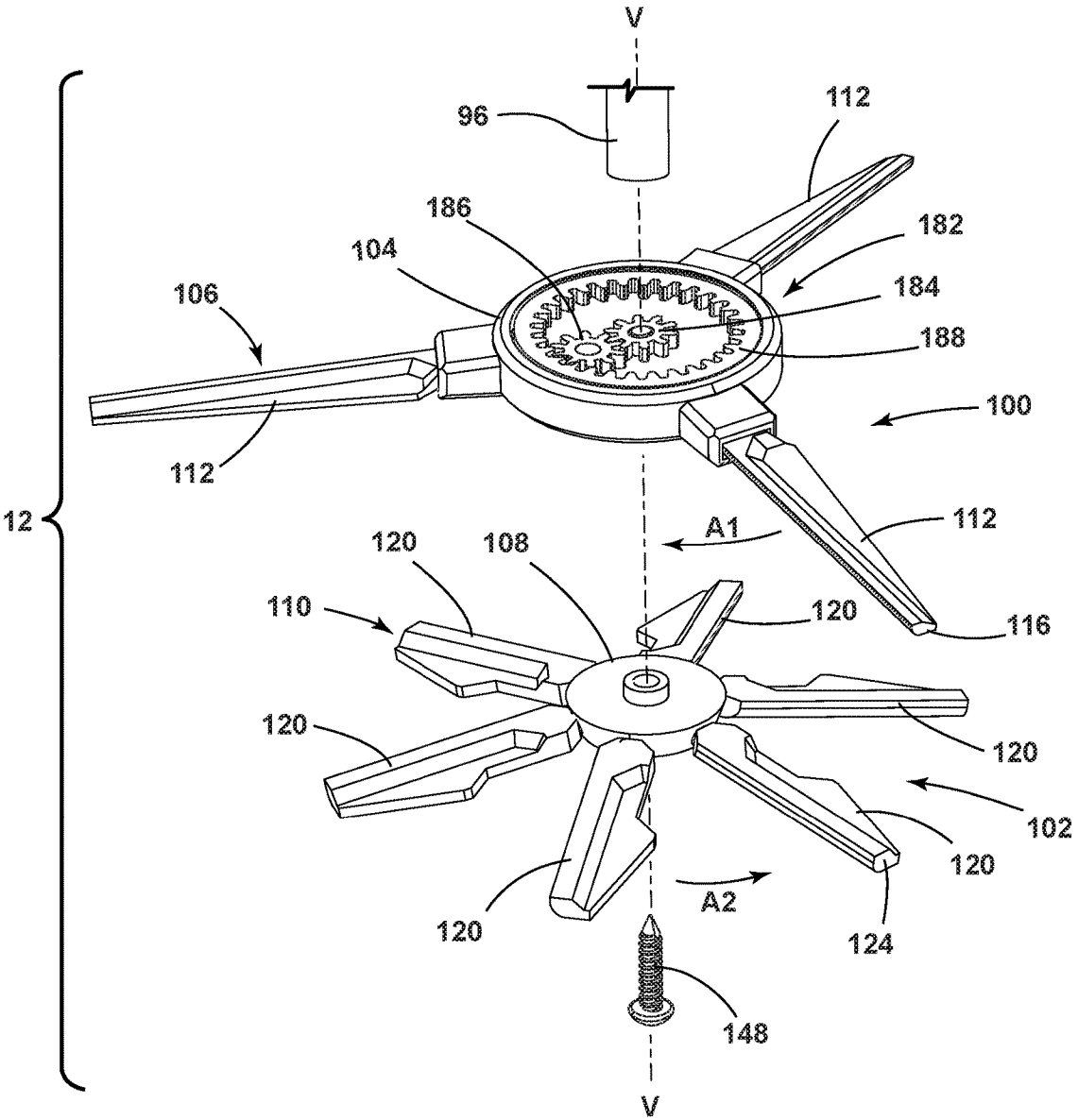
FIG. 17 is an exploded view of a fifth embodiment of an edge cleaning brush.

FIG. 17 is an exploded view of still another embodiment of the edge cleaning brush 12. The first cleaning implement 100 can be configured to contrarotate with respect to the second cleaning implement 102, which can minimize the effect of torque. The first rotational body 104 can rotate in the first direction A1 about the common axis V, and the second rotational body 108 can rotate in a second direction A2 about the common axis V, opposite the first direction A1.

In this embodiment, like the embodiment of FIGS. 8-11, the second cleaning implement 102 is directly connected with the brush motor shaft 96, or is otherwise operably coupled with the brush motor shaft 96 so that the second cleaning implement 102 rotates at the same speed, and in the same direction A2, as the shaft 96. The first cleaning implement 100 is coupled with the brush motor 50 by an epicyclic or planetary gear system 182 that modifies the driving force and driving direction produced by the brush motor 50, so that the first cleaning implement 100 rotates in an opposite direction A1 and at a lower speed than the second cleaning implement 102. While a planetary gear system is shown, other non-planetary gear arrangements are possible.

The planetary gear system 182 includes a sun gear 184, one or more fixed planetary gears 186 meshed with the sun gear 184, and an outer ring gear 188 meshed with the planetary gear 186 and rotating in an opposite direction as the sun gear 184. The sun gear 184 is fixed with the shaft 96 of the brush motor 50, and is configured to rotate on the axis V in direction A2 when driven by the brush motor 50. The first rotational body 104 is formed, joined, or otherwise coupled with the ring gear 188 for movement therewith. The ring gear 188 is driven by the fixed planetary gear 186 enmeshed with the sun gear 184 such that the ring gear 188 spins in the opposite direction A1 as the motor drive shaft 96. In other planetary gearbox configurations, another portion of the planetary gearbox can be held stationary, while a different portion can be driven, i.e. rotating, to produce different gear ratios.

Figure 18:
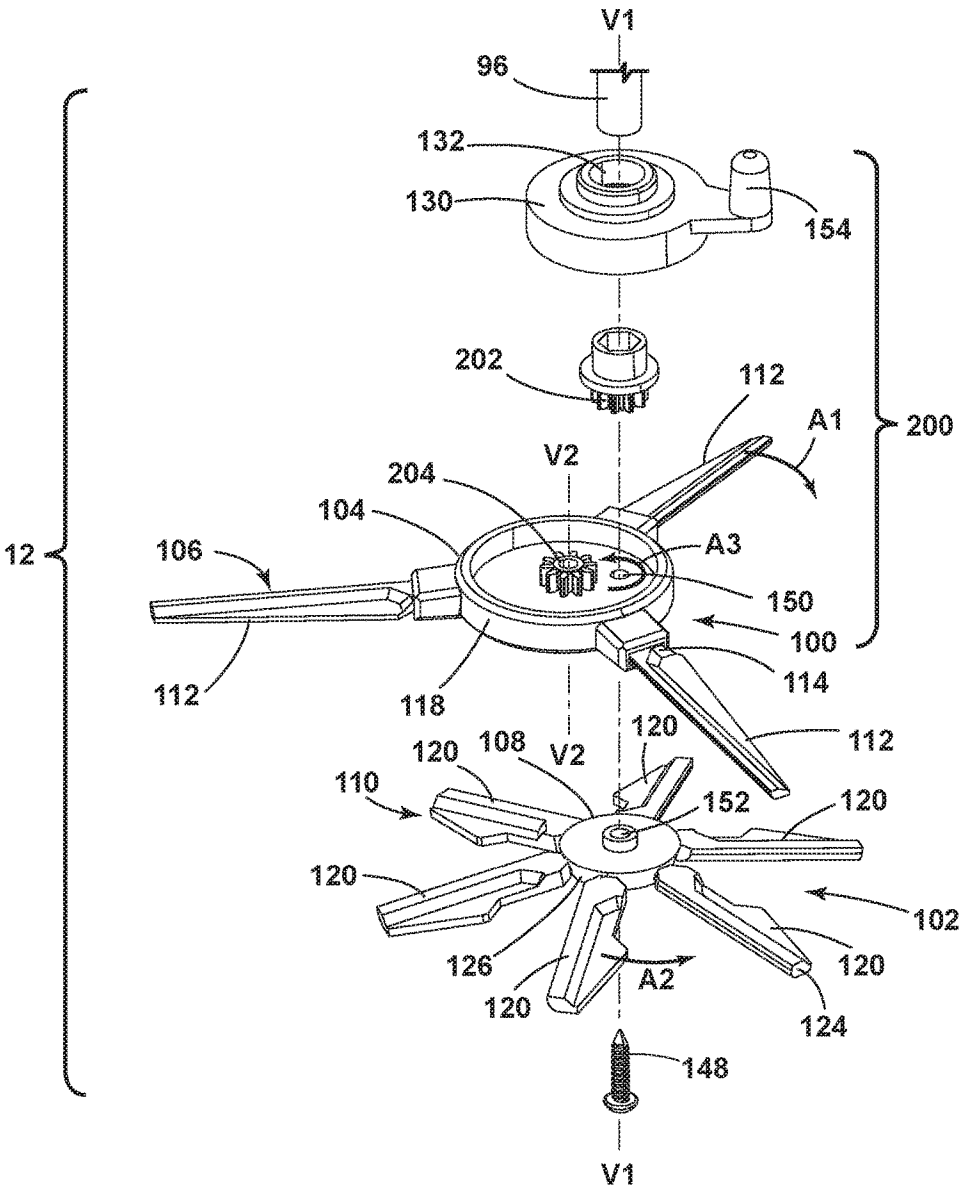
FIG. 18 is an exploded view of a sixth embodiment of an edge cleaning brush.

FIG. 18 is an exploded view of still another embodiment of the edge cleaning brush 12. The first cleaning implement 100 can be configured to rotate on an axis V2 that is offset from the axis V1 about which the second cleaning implement 102 rotates, and simultaneously orbits around the axis V1 in direction A3. Thus, the first and second cleaning implements 100, 102 of the present embodiment are non-concentric. The first cleaning implement 100 can also be configured to contrarotate with respect to the second cleaning implement 102, with the first rotational body 104 rotating in direction A1 about axis V2, and the second rotational body 108 rotating in direction A2 about axis V1. The direction A3 in which the first cleaning implement 100 orbits is the same as direction A2, and opposite direction A1.

In this embodiment, like the embodiment of FIGS. 8-11, the second cleaning implement 102 is directly connected with the brush motor shaft 96, or is otherwise operably coupled with the brush motor shaft 96 so that the second cleaning implement 102 rotates at the same speed, in the same direction A2, and on the same axis V1 as the shaft 96. The first cleaning implement 100 is coupled with the brush motor 50 by an epicyclic or planetary gear system 200 that modifies the driving force produced by the brush motor 50, so that the first cleaning implement 100 rotates at a lower speed, in an opposite direction A1, and on a different axis V2 than the second cleaning implement 102, while simultaneously orbiting around axis V1 as indicated by A3. While a planetary gear system is shown, other non-planetary gear arrangements are possible.

The planetary gear system 200 includes a sun gear 202, at least one planetary gear 204 meshed with the sun gear 202 and revolving around the sun gear 202, and an outer ring gear 138 (FIG. 10) meshed with the planetary gear 204 and fixed to the gear casing 130. While the ring gear 138 is not visible in FIG. 18, it is understood that the ring gear 138 is the same as, or substantially the same as, the ring gear 138 described with respect to FIG. 10.

The sun gear 202 is fixed with the shaft 96 of the brush motor 50, and is configured to rotate on the axis V1 in direction A2 when driven by the brush motor 50. The planetary gear 204 rolls around the sun gear 202 on the inside of the ring gear 138 (FIG. 10), which is fixed and non-rotatable, as previously described. The planetary gear 204, spaced from the central axis V1, is thereby forced to orbit or revolve in direction A3 as they rotate on axis V2. The first rotational body 104 is formed, joined, or otherwise coupled with the planetary gear 204 for rotation and revolution therewith.

Figure 19:
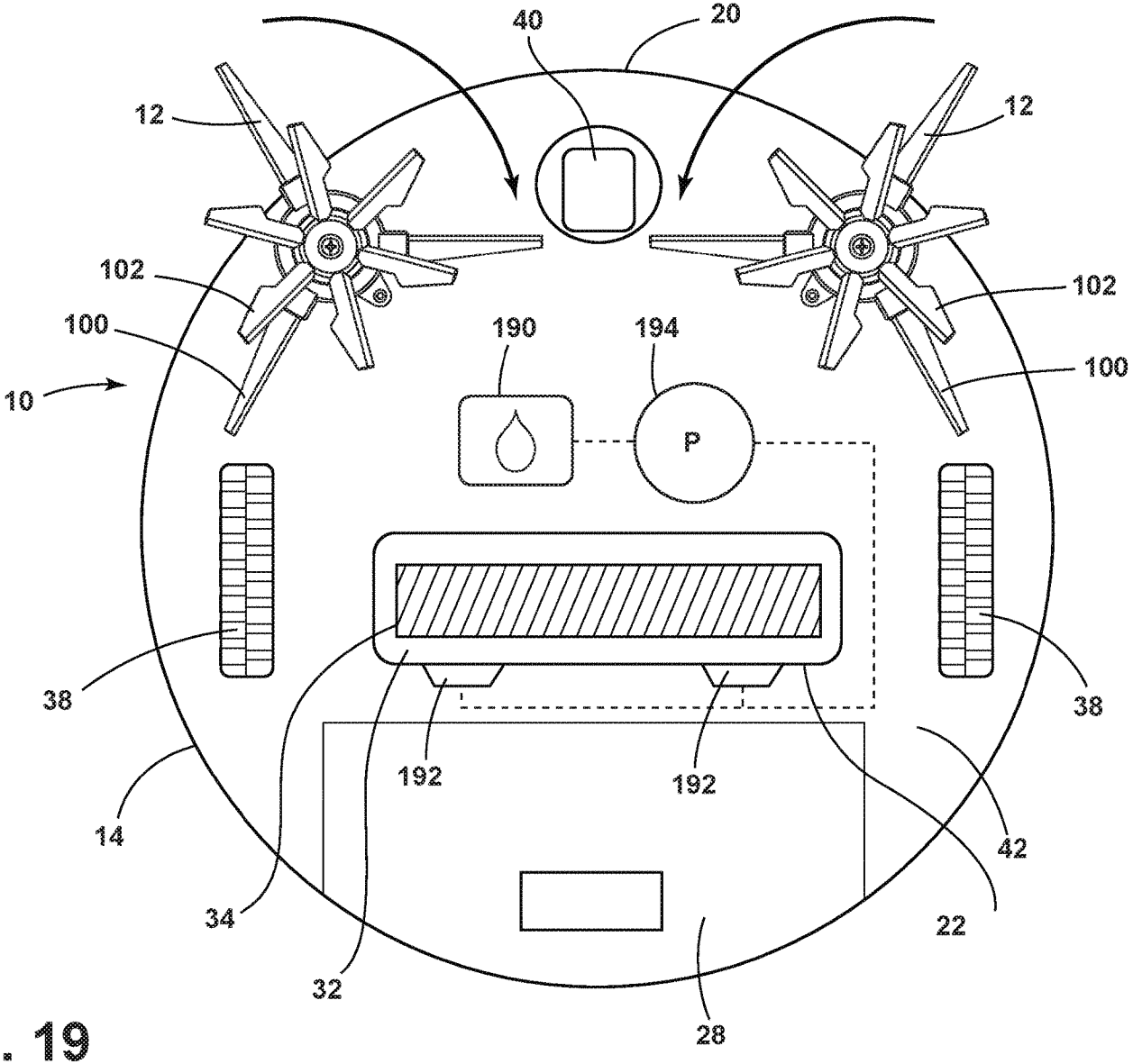
FIG. 19 is a bottom schematic view of an autonomous floor cleaner comprising a wet cleaning robot including one or more edge cleaning brushes according to a seventh embodiment.

FIG. 19 is a schematic view of another embodiment of a floor cleaning robot configured to sweep as well as dust, mop or otherwise conduct a wet or semi-wet cleaning cycle of operation, and can comprise any embodiment of edge cleaning brush 12 described herein. In additional to the previously described functional systems, the robot 10 mounts and/or carries the components of a cleaning fluid supply system in the autonomously moveable housing 14. Other autonomous cleaners requiring fluid supply or fluid recovery are contemplated, including, but not limited to autonomous floor cleaners capable of delivering liquid, steam, mist, or vapor to the surface to be cleaned.

The fluid delivery system can include a supply tank 190 for storing a supply of cleaning fluid and at least one fluid distributor 192 in fluid communication with the supply tank 190. The cleaning fluid can be a liquid such as water or a cleaning solution specifically formulated for hard surface cleaning. The term "cleaning fluid" includes liquids such as water or a cleaning solution, steam or vapor, unless otherwise noted.

The supply tank 190 can be mounted to the housing 14 in any configuration. In the present embodiment, the supply tank 190 can be removable from the housing 14 for filling or refilling. In other embodiments, the supply tank 190 can be disposable and replaceable.

The fluid distributor 192 can be one or more spray nozzles or spray tips provided on the housing 14 of the robot 10. Alternatively, the fluid distributor 192 can be a manifold having multiple outlets.

The fluid distributor 192 can be positioned to dispense cleaning fluid onto the surface to be cleaned, either directly onto the surface to be cleaned, such as by having an outlet of the fluid distributor 192 positioned in opposition to the surface, or indirectly onto the surface to be cleaned, such as by having an outlet of the fluid distributor 192 positioned to dispense onto an agitator such as brushroll 34, or one or both of the edge cleaning brushes 12. Alternatively, the fluid distributor 192 can be configured for spraying cleaning fluid outwardly from the housing 14 so that the user can see exactly where cleaning fluid is being dispensed. As yet another alternative, multiple fluid distributors can be provided to dispense cleaning fluid in various locations on the robot 10.

A fluid delivery pump 194 can be provided in the fluid pathway between the supply tank 190 and the fluid distributor 192 to control the flow of fluid to the fluid distributor 192. Various combinations of optional components can be incorporated into the fluid delivery system as is commonly known in the art, such as a heater for heating the cleaning fluid before it is applied to the surface, or one more fluid control and mixing valves.

The edge cleaning brush 12 can be used to scrub the surface to be cleaned in wet or semi-wet applications. For example, the faster-rotating inner cleaning implement 102 can provide deep scrubbing to the surface, while the slower-rotating outer cleaning implement 100 can sweep or dust the surface without scattering debris.

Figure 20:
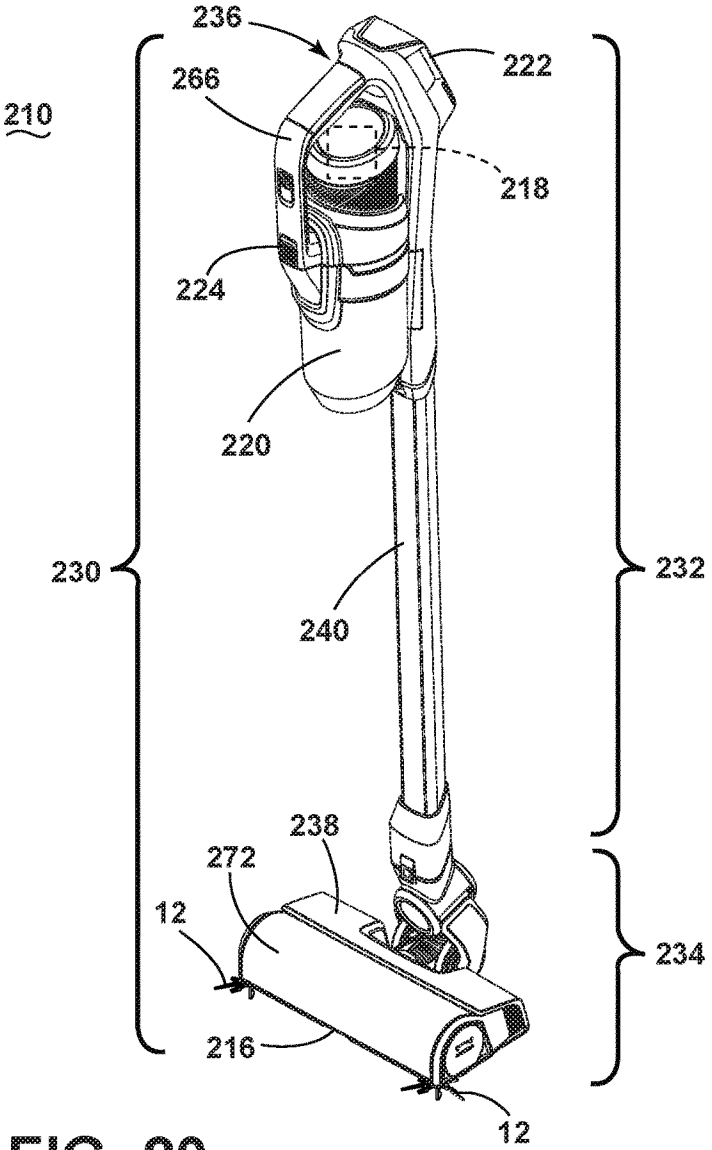
FIG. 20 is a perspective view of a surface cleaning apparatus comprising an upright floor cleaner including one or more edge cleaning brushes according to an eighth embodiment.

FIG. 20 is a perspective view of a floor cleaner 210 according to another embodiment, which can comprise any embodiment of edge cleaning brush 12 described herein. The floor cleaner 210 can be an upright floor cleaner, such as an upright vacuum cleaner or "stick" type vacuum cleaner, having a housing 230 with a floor cleaning base 234 and an upright body or assembly 232 for directing the base 234 across the surface to be cleaned. A detailed description of a vacuum cleaner can be found in, for example, in International Publication No. WO2020/006182, published Jan. 2, 2020, and which is incorporated herein by reference in its entirety. In the illustrated example, the vacuum cleaner is convertible between an upright mode and a hand-held mode, however it is contemplated that in other embodiments, the vacuum cleaner may be configured for use in an upright mode only.

It is contemplated that the vacuum cleaner 210 can include a recovery system for removing debris from the surface to be cleaned and storing the debris. The recovery system can include a suction inlet or suction nozzle 216, a suction source 218 (shown in phantom line in FIG. 20) in fluid communication with the suction nozzle 216 for generating a working airstream, and a recovery container 220 for separating and collecting debris from the working airstream for later disposal. The recovery container 220 can include a collection bin for collecting dirt from the working airstream for later disposal. The recovery container 220 can include a separator for separating entrained debris from the working airstream. Some non-limiting examples of the separator include a cyclone separator, a filter screen, a foam filter, a HEPA filter, a filter bag, or combinations thereof.

The suction source 218 can be any suitable suction source and is provided in fluid communication with the recovery container 220. By way of non-limiting example, the suction source 218 can includes a motor/fan assembly. The suction source 218 can be electrically coupled to a power source 222, such as a battery or by a power cord plugged into a household electrical outlet. A suction power switch 224 between the suction source 218 and the power source 222 can be selectively closed by the user, thereby activating the suction source 218.

The upright assembly 232 can include a hand-held portion 236 supporting components of the recovery system, including, but not limited to, the suction source 218 and the recovery container 220, as well as other components, such as the power source or battery. The hand-held portion 236 can be removably coupled to a wand 240, and can further include a hand grip 266 for maneuvering the vacuum cleaner 210 over a surface to be cleaned and for using the vacuum cleaner 210 in hand-held mode.

Figure 21:
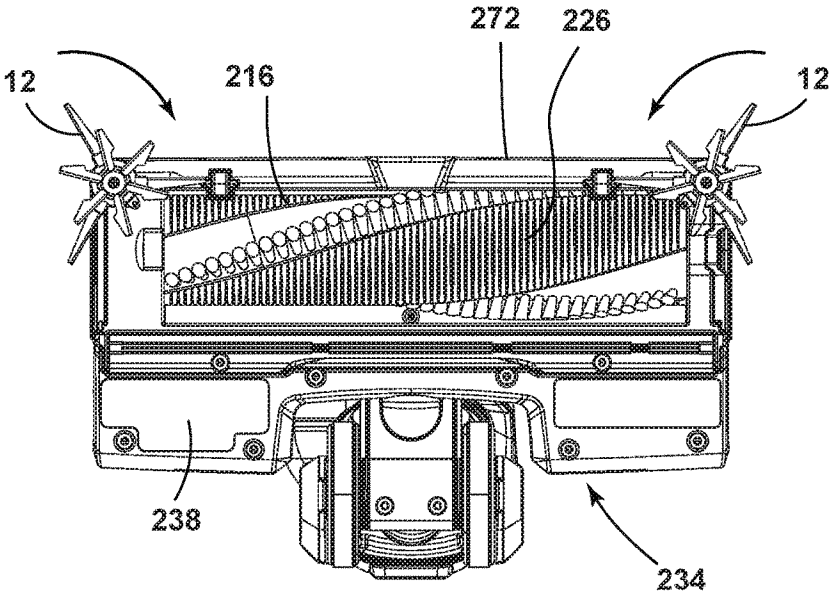
FIG. 21 is a bottom view of the surface cleaning apparatus from FIG. 20.

Referring to FIG. 21, the vacuum cleaner 210 shown includes two edge cleaning brushes 12 on an underside of the base 234. The base 234 can include a base housing 238 adapted for movement over a surface to be cleaned, with the edge cleaning brushes 12 on the underside of the base housing 238. In other embodiments, a single edge cleaning brush 12 can be provided on the base 234

The suction nozzle 216 can be provided on the base 234, generally between the edge cleaning brushes 12. An agitator 226 can be provided adjacent to the suction nozzle 216 for agitating the surface to be cleaned so that the debris is more easily ingested into the suction nozzle 216. Some examples of agitators 226 include, but are not limited to, a horizontally-rotating brushroll, dual horizontally-rotating brushrolls, one or more vertically-rotating brushrolls, or a stationary brush. An agitator housing 272 is provided around the suction nozzle 216 and defines a chamber for the agitator 226. The agitator housing 272 can form a forward portion of the base housing 234.

The agitator 226 can generally lie between the edge cleaning brushes 12, with the edge cleaning brushes 12 configured to sweep debris under the base housing 238 and toward the suction nozzle 216 and agitator 226. In other embodiments, an agitator is not provided, and the edge cleaning brushes 12 are configured to sweep debris under the base housing 238 and toward the suction nozzle 216.

While shown herein on an autonomous floor cleaner, the various embodiments of edge cleaning brushes disclosed herein can be provided on surface cleaning apparatus with similar functional systems arranged in other configurations, such as an upright device having a floor cleaning base with one or more edge cleaning brushes and an upright body for directing the base across the surface to be cleaned, a canister device having a cleaning implement with one or more edge cleaning brushes connected to a wheeled base by a vacuum hose, a portable device adapted to be hand carried by a user for cleaning relatively small areas, or a commercial device. Any of the aforementioned cleaners can be adapted as a battery-powered apparatus, including an on-board battery for cordless operation. Any of the aforementioned cleaners can be adapted as multi-surface cleaning apparatus that can be used to clean hard floor surfaces such as tile and hardwood and soft floor surfaces such as carpet, and can perform both dry and wet cleaning. Aspects of the disclosure may also be incorporated into a steam apparatus, such as surface cleaning apparatus with steam delivery. Aspects of the disclosure may also be incorporated into an apparatus with only recovery or dry vacuuming capabilities, such as surface cleaning apparatus without fluid delivery.

There are several advantages of the present disclosure arising from the various aspects or features of the apparatus, systems, and methods described herein. For example, aspects described above provide an autonomous cleaning robot with an edge cleaning brush with multiple cleaning implements and a planetary gear system for driving the cleaning implements at different speeds. One problem with conventional edge cleaning brushes that the tip velocity is too fast, which flings debris outwardly rather than brushing debris inwardly toward the housing. Additionally, the inner area covered by the brush is too slow for effective cleaning, or may not be contact with the floor surface to effect any kind of cleaning at all. With the embodiments of the edge cleaning brushes disclosed herein, different types of cleaning elements can be combined while still rotating each cleaning element at a desired rotational velocity.

To the extent not already described, the different features and structures of the various embodiments of the invention, may be used in combination with each other as desired, or may be used separately. That one autonomous floor cleaner or floor cleaning robot is illustrated herein as having all of these features does not mean that all of these features must be used in combination, but rather done so here for brevity of description. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A floor cleaner for cleaning a floor surface, comprising:
- a housing adapted for movement over a surface to be cleaned;
- an edge brush motor comprising a drive shaft;
- an edge cleaning brush mounted on the housing and coupled with the edge brush motor via the drive shaft, wherein the edge cleaning brush comprises:
  - a first cleaning implement configured to rotate at a first speed; and
  - a second cleaning implement configured to rotate at a second speed that is greater than the first speed;
- wherein the drive shaft defines a rotational axis of the edge brush, and wherein the first and second cleaning implements are concentrically aligned to rotate about the rotational axis.

2. The floor cleaner of claim 1 wherein each of the first and second cleaning implements comprises a rotational body configured to rotate with respect to the housing and a cleaning element configured to contact the surface to be cleaned.

3. The floor cleaner of claim 2 wherein the cleaning element of the first cleaning implement comprises a set of blades having a first length and the cleaning element of the second cleaning implement comprises a set of blades having a second length that is less than the first length.

4. The floor cleaner of claim 2 wherein the cleaning element of the first cleaning implement comprises a set of bristles having a first length and the cleaning element of the second cleaning implement comprises a set of bristles having a second length that is less than the first length.

5. The floor cleaner of claim 4 wherein the rotational bodies of the first and second cleaning implements are configured to rotate such that the tangential velocities of a distal end of the bristles of the first length is at least as great as the tangential velocity of a distal end of the bristles of the second length.

6. The floor cleaner of claim 2 wherein the cleaning element of the second cleaning implement is a microfiber pad.

7. The floor cleaner of claim 6 wherein the cleaning element of the first cleaning implement is a set of bristles, wherein a distal end of the set of bristles extends beyond an outer edge of the microfiber pad.

8. The floor cleaner of claim 1 wherein the first and second cleaning implements are configured to contrarotate.

9. The floor cleaner of claim 8 further comprising a gear box that is configured to drive the first cleaning implement in an opposite direction as the second cleaning implement.

10. The floor cleaner of claim 1 further comprising a gear box that is configured to drive the first and second cleaning implements at predetermined and differing rotational speeds.

11. The floor cleaner of claim 10 wherein the gear box is disposed external to the housing.

12. The floor cleaner of claim 10 wherein the gear box is disposed internal to the housing.

13. The floor cleaner of claim 10 wherein the gear box includes a planetary gear system.

14. The floor cleaner of claim 1 wherein the first cleaning implement is driven at 60 to 200 rpm and the second cleaning implement is driven at 180 to 800 rpm.

15. The floor cleaner of claim 1, comprising a brushroll mounted in a brush chamber on the housing, the brushroll mounted for rotation about a brushroll axis, and the edge cleaning brush mounted on edge of housing for rotation about the rotational axis.

16. The floor cleaner of claim 15, comprising:

a vacuum collection system including a working air path through the housing having an inlet defined by a suction nozzle and an outlet defined by exhaust vents, a suction source in fluid communication with the suction nozzle for generating a working airstream through the working air path, and a collection bin for collecting dirt from the working airstream for later disposal;

wherein the edge cleaning brush is mounted forward of the brushroll and the suction nozzle.

17. The floor cleaner of claim 1, comprising an autonomous floor cleaning robot having a controller and a drive system for autonomously moving the housing over a surface to be cleaned based on inputs from the controller.

18. The floor cleaner of claim 17, comprising:

a vacuum collection system including a working air path through the housing having an inlet defined by a suction nozzle and an outlet defined by exhaust vents, a suction source in fluid communication with the suction nozzle for generating a working airstream through the working air path, and a collection bin for collecting dirt from the working airstream for later disposal; and a brushroll mounted in a brush chamber on the housing for rotation about a brushroll axis;

wherein the drive system comprises drive wheels for driving the housing across the surface to be cleaned, and the drive wheels are mounted between forward and rearward ends of the housing, and are spaced laterally from each other; and wherein the edge cleaning brush is mounted at a forward end of the autonomous floor cleaning robot, forwardly of the suction nozzle, the brushroll, and the drive wheels, and wherein the edge cleaning brush is configured to sweep debris toward the suction nozzle.

19. A floor cleaner for cleaning a floor surface, comprising:

a housing adapted for movement over a surface to be cleaned;

an edge brush motor comprising a drive shaft;

an edge cleaning brush mounted on the housing, wherein the edge cleaning brush comprises:

a first cleaning implement; and a second cleaning implement coupled with the drive shaft to rotate at the same speed as the drive shaft; and a gear system coupling the first cleaning implement with the edge brush motor, the gear system modifying a driving force produced by the edge brush motor to rotate the first cleaning implement at a speed less than the speed of the drive shafts;

wherein the drive shaft defines a rotational axis of the edge brush, and wherein the first and second cleaning implements are concentrically aligned to rotate about the rotational axis.

* * * * *